US007551878B2

(12) United States Patent
Ogaki et al.

(10) Patent No.: US 7,551,878 B2
(45) Date of Patent: Jun. 23, 2009

(54) ELECTROPHOTOGRAPHIC PHOTOSENSITIVE MEMBER, PROCESS CARTRIDGE, AND ELECTROPHOTOGRAPHIC APPARATUS

(75) Inventors: Harunobu Ogaki, Suntoh-gun (JP); Hiroki Uematsu, Suntoh-gun (JP); Masataka Kawahara, Mishima (JP); Atsushi Ochi, Numazu (JP); Kyoichi Teramoto, Abiko (JP); Akira Shimada, Suntoh-gun (JP); Akio Maruyama, Tokyo (JP); Toshihiro Kikuchi, Yokohama (JP); Akio Koganei, Ichikawa (JP); Takayuki Sumida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 69 days.

(21) Appl. No.: 11/770,109

(22) Filed: Jun. 28, 2007

(65) Prior Publication Data

US 2008/0019735 A1 Jan. 24, 2008

Related U.S. Application Data

(63) Continuation of application No. PCT/JP2007/051869, filed on Jan. 30, 2007.

(30) Foreign Application Priority Data

| | | |
|---|---|---|
| Jan. 31, 2006 | (JP) | 2006-022896 |
| Jan. 31, 2006 | (JP) | 2006-022898 |
| Jan. 31, 2006 | (JP) | 2006-022899 |
| Jan. 31, 2006 | (JP) | 2006-022900 |
| Jan. 26, 2007 | (JP) | 2007-016216 |

(51) Int. Cl.
*G03G 15/00* (2006.01)

(52) U.S. Cl. ..... 399/159

(58) Field of Classification Search ..... 399/159; 430/58.7, 66

See application file for complete search history.

(56) References Cited

U.S. PATENT DOCUMENTS

| | | | | |
|---|---|---|---|---|
| 5,082,756 | A | 1/1992 | Doi | 430/67 |
| 5,114,814 | A | 5/1992 | Sakoh et al. | 430/46 |
| 5,242,773 | A | 9/1993 | Iino et al. | 430/58 |
| 5,242,776 | A | 9/1993 | Doi et al. | 430/67 |
| 5,411,827 | A | 5/1995 | Tamura et al. | 430/58 |
| 5,496,671 | A | 3/1996 | Tamura et al. | 430/58 |

(Continued)

FOREIGN PATENT DOCUMENTS

| | | |
|---|---|---|
| JP | 52-026226 | 2/1977 |

(Continued)

OTHER PUBLICATIONS

Translation of IPER dated Aug. 21, 2008 on PCT/JP 2007/051869.

*Primary Examiner*—Hoang Ngo
(74) *Attorney, Agent, or Firm*—Fitzpatrick, Cella, Harper & Scinto

(57) ABSTRACT

An electrophotographic photosensitive member has, on the surface of its photosensitive layer, has a plurality of depressed portions which are independent from one another, and, where the major-axis diameter of each depressed portion is represented by Rpc and the depth that shows the distance between the deepest part of each depressed portion and the opening thereof is represented by Rdv, the depressed portions each have a ratio of depth to major-axis diameter, Rdv/Rpc, of from more than 1.0 to 7.0 or less.

7 Claims, 15 Drawing Sheets

U.S. PATENT DOCUMENTS

| | | | | |
|---|---|---|---|---|
| 6,180,303 | B1 | 1/2001 | Uematsu et al. | 430/59.6 |
| 7,186,489 | B2 | 3/2007 | Uematsu et al. | 430/66 |
| 7,226,711 | B2 | 6/2007 | Amamiya et al. | 430/58.7 |
| 2005/0255393 | A1 | 11/2005 | Nakata et al. | 430/56 |
| 2006/0019185 | A1* | 1/2006 | Amamiya et al. | 430/66 |
| 2007/0254232 | A1 | 11/2007 | Kawahara et al. | 430/119.71 |

FOREIGN PATENT DOCUMENTS

| | | |
|---|---|---|
| JP | 53-092133 | 8/1978 |
| JP | 57-094772 | 6/1982 |
| JP | 01-099060 | 4/1989 |
| JP | 02-127562 | 5/1990 |
| JP | 02-139566 | 5/1990 |
| JP | 02-150850 | 6/1990 |
| JP | 02-187784 | 7/1990 |
| JP | 02-214869 | 8/1990 |
| JP | 03-059562 | 3/1991 |
| JP | 04-175759 | 6/1992 |
| JP | 04-175767 | 6/1992 |
| JP | 05-216249 | 8/1993 |
| JP | 07-007640 | 1/1995 |
| JP | 10-039521 | 2/1998 |
| JP | 2000-066424 | 3/2000 |
| JP | 2000-066425 | 3/2000 |
| JP | 2001-066814 | 3/2001 |
| WO | WO 2005/093518 | 10/2005 |

* cited by examiner

ELECTROPHOTOGRAPHIC PHOTOSENSITIVE MEMBER, PROCESS CARTRIDGE, AND ELECTROPHOTOGRAPHIC APPARATUS

This application is a continuation of International Application No. PCT/JP2007/051869, filed Jan. 30, 2007, which claims the benefit of Japanese Patent Application No. 2006-022896, filed Jan. 31, 2006, Japanese Patent Application No. 2006-022898, filed Jan. 31, 2006, Japanese Patent Application No. 2006-022899, filed Jan. 31, 2006, Japanese Patent Application No. 2006-022900, filed Jan. 31, 2006, and Japanese Patent Application No. 2007-016216, filed Jan. 26, 2007.

BACKGROUND OF THE INVENTION

1. Field of the Invention

This invention relates to an electrophotographic photosensitive member, and a process cartridge and an electrophotographic apparatus which have the electrophotographic photosensitive member.

2. Description of the Related Art

As an electrophotographic photosensitive member (hereinafter also simply "photosensitive member"), in view of advantages of low prices and high productivity, an organic electrophotographic photosensitive member has become popular, which has a support and provided thereon a photosensitive layer (organic photosensitive layer) making use of organic materials as photoconductive materials (such as a charge generating material and a charge transporting material). As the organic electrophotographic photosensitive member, in view of advantages such as a high sensitivity and a variety for material designing, an electrophotographic photosensitive member is prevalent which has a multi-layer type photosensitive layer having a charge generation layer containing a charge generating material and a charge transport layer containing a charge transporting material; the layers being superposed to form the photosensitive layer. The charge generating material may include photoconductive dyes and photoconductive pigments. The charge transporting material may include photoconductive polymers and photoconductive low-molecular weight compounds.

The electrophotographic photosensitive member is used under direct application of electrical external force and/or mechanical external force of charging, exposure, development, transfer and cleaning, and hence is required to have durability to such external force. Stated specifically, the photosensitive member is required to have durability to the scratching and wear of surface that come about because of such external force, i.e., scratch resistance and wear resistance.

In regard to improvement in the wear resistance, polycarbonate resin has hitherto widely been used as a binder resin for surface layers of electrophotographic photosensitive members. However, in recent years, it is proposed that polyarylate resin, which has a higher mechanical strength than the polycarbonate resin, is used as a binder resin for the surface layers so that electrophotographic photosensitive members can be more improved in durability (running performance) (see, e.g., Japanese Patent Application Laid-open No. H10-39521). The polyarylate resin is one of aromatic dicarboxylic acid polyester resins.

Japanese Patent Application Laid-open No. H02-127652 discloses an electrophotographic photosensitive member having as a surface layer a cured layer making use of a curable resin as a binder resin. Japanese Patent Applications Laid-open No. H05-216249 and No. H07-072640 also disclose an electrophotographic photosensitive member having as a surface layer a charge transporting cured layer formed by subjecting monomers to cure polymerization in the presence of energy of heat or light; the monomers being a binder resin monomer having a carbon-carbon double bond and a monomer having a charge transporting function and having a carbon-carbon double bond. Japanese Patent Applications Laid-open No. 2000-066424 and No. 2000-066425 further disclose an electrophotographic photosensitive member having as a surface layer a charge transporting cured layer formed by subjecting a compound to cure polymerization in the presence of energy of electron rays; the compound being a hole transporting compound having a chain-polymerizable functional group in the same molecule.

Thus, in recent years, as a technique by which the scratch resistance and wear resistance of the peripheral surfaces of organic electrophotographic photosensitive members are improved, a technique has been proposed in which the surface layers of electrophotographic photosensitive members are formed as cured layers so as to improve the mechanical strength of the surface layers.

Now, the electrophotographic photosensitive member is commonly used in an electrophotographic image forming process having, as mentioned above, a charging step, an exposure step, a developing step, a transfer step and a cleaning step. Of the electrophotographic image forming process, the cleaning step, in which transfer residual toner remaining on the electrophotographic photosensitive member after the transfer step is removed to clean the peripheral surface of the electrophotographic photosensitive member, is an important step in order to obtain sharp images. A cleaning method making use of a cleaning blade is a cleaning method operated by bringing the cleaning blade and the electrophotographic photosensitive member into friction with each other. Some fictional force between the cleaning blade and the electrophotographic photosensitive member may cause phenomena such as chattering of the cleaning blade and turn-up of the cleaning blade. Here, the chattering of the cleaning blade is a phenomenon in which the frictional resistance acting between the cleaning blade and the peripheral surface of the electrophotographic photosensitive member becomes so high as to make the cleaning blade vibrate. The turn-up of the cleaning blade is a phenomenon in which the cleaning blade comes reversed in the direction of surface movement of the electrophotographic photosensitive member.

These problems involved in the cleaning blade and electrophotographic photosensitive member show a tendency to become remarkable as the surface layer of the electrophotographic photosensitive member has a higher wear resistance to make the peripheral surface of the electrophotographic photosensitive member not more easily wear. In addition, the surface layer of the organic electrophotographic photosensitive member is commonly often formed by dip coating, and the surface of a surface layer formed by this dip coating shows a tendency to be smoother. Hence, the cleaning blade and the peripheral surface of the electrophotographic photosensitive member come into contact with each other in a larger area and the cleaning blade and the peripheral surface of the electrophotographic photosensitive member come into friction with each other in a higher resistance. Thus, the above problems show a tendency to become remarkable.

As one of methods for overcoming these problems involved in the cleaning blade and electrophotographic photosensitive member (chattering of the cleaning blade and turn-up of the cleaning blade), a method is proposed in which the surface of the electrophotographic photosensitive member is appropriately roughened.

As a method of roughening the surface of the electrophotographic photosensitive member, Japanese Patent Application Laid-open No. S53-92133 discloses a technique in which the surface roughness of the electrophotographic photosensitive member is controlled within a specific range in order to make transfer materials readily separable from the surface of the electrophotographic photosensitive member. Japanese Patent Application Laid-open No. S53-092133 also discloses a method in which drying conditions in forming a surface layer is controlled to roughen the surface of the electrophotographic photosensitive member in orange peel. Japanese Patent Application Laid-open No. S52-026226 discloses a technique in which the surface layer is incorporated with particles to roughen the surface of the electrophotographic photosensitive member. Japanese Patent Application Laid-open No. S57-094772 discloses a technique in which the surface of a surface layer is polished with a wire brush made of a metal to roughen the surface of the electrophotographic photosensitive member. Japanese Patent Application Laid-open No. H01-99060 discloses a technique in which a specific cleaning device and a toner are used to roughen the surface of an organic electrophotographic photosensitive member. According to this Japanese Patent Application Laid-open No. H01-099060, it is described that the problems of turn-up of the cleaning blade and chipping of edges thereof can be solved which may come into question when used in an electrophotographic apparatus having a certain higher process speed.

Japanese Patent Application Laid-open No. H02-139566 discloses a technique in which the surface of a surface layer is polished with a filmy abrasive to roughen the surface of the electrophotographic photosensitive member. Japanese Patent Application Laid-open No. H02-150850 discloses a technique in which blasting is carried out to roughen the surface of the electrophotographic photosensitive member. This, however, has no specific disclosure as to details of surface profile of the electrophotographic photosensitive member surface-roughed by such a method. International Publication No. WO2005/93518A1 discloses a technique in which the above blasting is carried out to roughen the peripheral surface of the electrophotographic photosensitive member, and discloses an electrophotographic photosensitive member having a stated dimple profile. It is described therein that improvements have been achieved in regard to smeared images tending to come about in a high-temperature and high-humidity environment and transfer performance of toner. Japanese Patent Application Laid-open No. 2001-066814 also discloses a technique in which the surface of the electrophotographic photosensitive member is processed by compression forming by means of a stamper having unevenness in the form of wells.

SUMMARY OF THE INVENTION

However, on the surfaces of the electrophotographic photosensitive members disclosed in the above Japanese Patent Application Laid-open No. S53-092133, Japanese Patent Application Laid-open No. S52-026226, Japanese Patent Application Laid-open No. S57-094772, Japanese Patent Application Laid-open No. H01-099060, Japanese Patent Application Laid-open No. H02-139566, Japanese Patent Application Laid-open No. H02-150850 and International Publication No. WO2005/93518A1, it can be ascertained that any uniformity is not achieved in microscopic regions when regions surface-processed by roughening are observed within ranges of few μm in area. It also can not be said that the surfaces have been roughened (have surface unevenness profile) highly effective enough to remedy the chattering of the cleaning blade and turn-up of the cleaning blade. This is considered to be the reason why the problems of chattering of the cleaning blade and turn-up of the cleaning blade have not come to be sufficiently solved. Thus, further improvement is demanded.

The above Japanese Patent Application Laid-open No. 2001-066814 has disclosure regarding the surface of an electrophotographic photosensitive member having been microprocessed, but has no disclosure as to how to remedy the chattering of the cleaning blade and turn-up of the cleaning blade.

An object of the present invention is to provide an electrophotographic photosensitive member improved in cleaning performance and also having a good image reproducibility, even in its long-term service, and a process cartridge and an electrophotographic apparatus which have the electrophotographic photosensitive member.

As a result of extensive studies, the present inventors have discovered that the surface of an electrophotographic photosensitive member may be made to have specific depressed portions or hollows to thereby remedy the above problems effectively, thus they have accomplished the present invention.

More specifically, the electrophotographic photosensitive member of the present invention is concerned with an electrophotographic photosensitive member having a support and provided thereon a photosensitive layer, wherein the electrophotographic photosensitive member has a surface having a plurality of depressed portions which are independent from one another, and, where the major-axis diameter of each depressed portion is represented by Rpc and the depth that shows the distance between the deepest part of each depressed portion and the opening thereof is represented by Rdv, the depressed portions each have a ratio of depth to major-axis diameter, Rdv/Rpc, of from more than 1.0 to 7.0 or less.

The present invention is also concerned with a process cartridge having the above electrophotographic photosensitive member, and at least one device selected from the group consisting of a charging device, a developing device and a cleaning device; the process cartridge being detachably mountable to the main body of an electrophotographic apparatus.

The present invention is also concerned with an electrophotographic apparatus having the above electrophotographic photosensitive member, a charging device, an exposure device, a developing device and a transfer device.

The electrophotographic photosensitive member of the present invention can provide an electrophotographic photosensitive member improved in cleaning performance and also having a good image reproducibility, even in its long-term service, and a process cartridge and an electrophotographic apparatus which have such an electrophotographic photosensitive member.

Further features of the present invention will become apparent from the following description of exemplary embodiments with reference to the attached drawings.

DESCRIPTION OF THE EMBODIMENTS

Figure 1A:
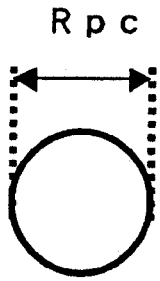
FIG. 1A is a view showing an example of the shape of a depressed portion (top view) in the present invention.
Figure 1B:
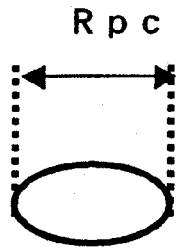
FIG. 1B, a view showing an example of the shape of a depressed portion (top view) in the present invention.
Figure 1C:
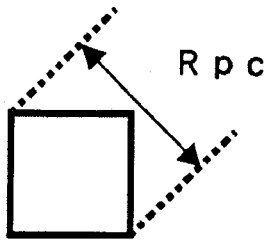
FIG. 1C, a view showing an example of the shape of a depressed portion (top view) in the present invention.
Figure 1D:
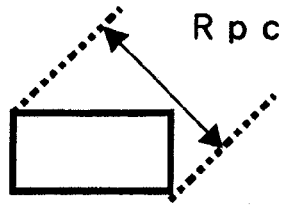
FIG. 1D, a view showing an example of the shape of a depressed portion (top view) in the present invention.
Figure 1E:
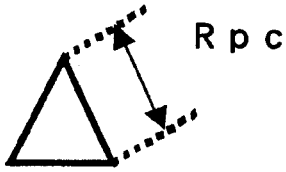
FIG. 1E, a view showing an example of the shape of a depressed portion (top view) in the present invention.
Figure 1F:
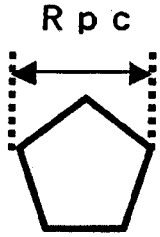
FIG. 1F, a view showing an example of the shape of a depressed portion (top view) in the present invention.
Figure 1G:
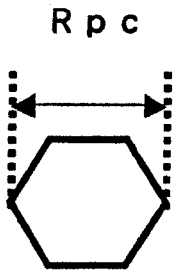
FIG. 1G, a view showing an example of the shape of a depressed portion (top view) in the present invention.
Figure 2A:
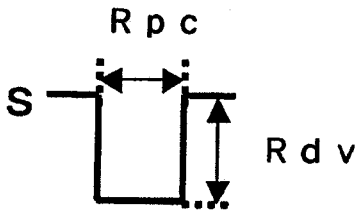
FIG. 2A is a view showing an example of the shape of a depressed portion (cross section) in the present invention.
Figure 2B:
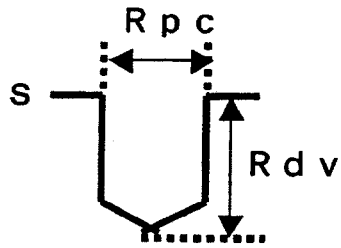
FIG. 2B, a view showing an example of the shape of a depressed portion (cross section) in the present invention.
Figure 2C:
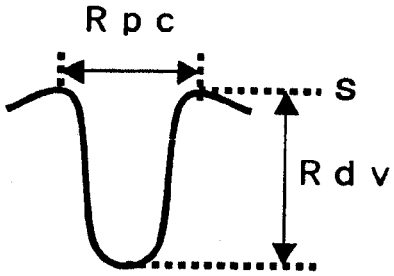
FIG. 2C, a view showing an example of the shape of a depressed portion (cross section) in the present invention.
Figure 2D:
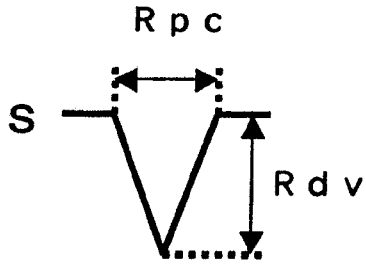
FIG. 2D, a view showing an example of the shape of a depressed portion (cross section) in the present invention.
Figure 2E:
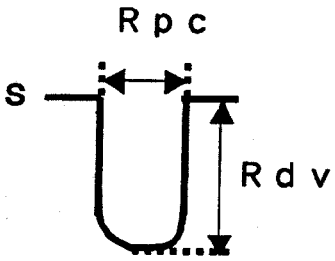
FIG. 2E, a view showing an example of the shape of a depressed portion (cross section) in the present invention.
Figure 2F:
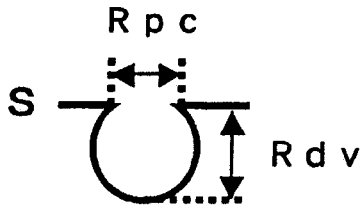
FIG. 2F, a view showing an example of the shape of a depressed portion (cross section) in the present invention.
Figure 2G:
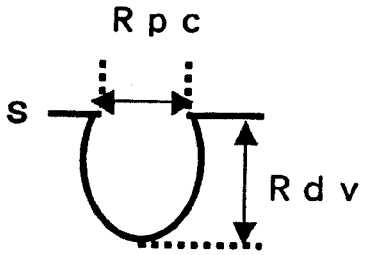
FIG. 2G, a view showing an example of the shape of a depressed portion (cross section) in the present invention.

Preferred embodiments of the present invention will now be described in detail in accordance with the accompanying drawings.

The electrophotographic photosensitive member of the present invention is, as described above, an electrophotographic photosensitive member having a support and provided thereon a photosensitive layer, wherein the electrophotographic photosensitive member has a surface having a plurality of depressed portions which are independent from one another, and, where the major-axis diameter of each depressed portion is represented by Rpc and the depth that shows the distance between the deepest part of each depressed portion and the opening thereof is represented by Rdv, the depressed portions each have a ratio of depth to major-axis diameter, Rdv/Rpc, of from more than 1.0 to 7.0 or less.

The depressed portions in the present invention which are independent from one another refer to depressed portions which individually stand clearly separated from other depressed portions. The depressed portions formed on the surface of the electrophotographic photosensitive member in the present invention may include, e.g., in the observation of the photosensitive member surface, those having a shape in which they are each constituted of straight lines, those having a shape in which they are each constituted of curved lines, and those having a shape in which they are each constituted of straight lines and curved lines. The shape in which they are constituted of straight lines may include, e.g., triangles, quadrangles, pentagons and hexagons. The shape in which they are constituted of curved lines may include, e.g., circles and ellipses. The shape in which they are constituted of straight lines and curved lines may include, e.g., quadrangles with round corners, hexagons with round corners, and sectors.

The depressed portions formed on the surface of the electrophotographic photosensitive member in the present invention may also include, e.g., in the observation of the photosensitive member cross section, those having a shape in which they are each constituted of straight lines, those having a shape in which they are each constituted of curved lines, and those having a shape in which they are each constituted of straight lines and curved lines. The shape in which they are constituted of straight lines may include, e.g., triangles, quadrangles and pentagons. The shape in which they are constituted of curved lines may include, e.g., partial circles and partial ellipses. The shape in which they are constituted of straight lines and curved lines may include, e.g., quadrangles with round corners, and sectors.

As specific examples of the depressed portions of the electrophotographic photosensitive member surface in the present invention, they may include depressed portions shown in FIGS. 1A to 1G (shape examples of depressed portions in surface top plan views) and FIGS. 2A to 2G (shape examples of depressed portions in sectional views). The depressed portions of the electrophotographic photosensitive member surface in the present invention may individually have different shapes, sizes and depths. They may also all have the same shape, size and depth. The surface of the electrophotographic photosensitive member may further be a surface having in combination the depressed portions which individually have different shapes, sizes and depths and the depressed portions which have the same shape, size and depth.

The major-axis diameter in the present invention refers to the length of a straight line which is longest among straight lines crossing the opening of each depressed portion. Stated specifically, as shown by major-axis diameter Rpc in FIGS. 1A to 1G and by major-axis diameter Rpc in FIGS. 2A to 2G, it refers to the maximum length of the surface opening in each depressed portion, on the basis of the surface that surrounds openings of the depressed portions of the surface in the electrophotographic photosensitive member. For example, where a depressed portion has an opening shape of a circle, the major-axis diameter refers to the diameter. Where a depressed portion has an opening shape of an ellipse, the major-axis diameter refers to the lengthwise diameter. Where a depressed portion has an opening shape of a quadrangle, the major-axis diameter refers to the longer diagonal line among diagonal lines.

The depth in the present invention refers to the distance between the deepest part of each depressed portion and the opening thereof. Stated specifically, as shown by depth Rdv in FIGS. 2A to 2G, it refers to the distance between the deepest part of each depressed portion and the opening thereof, on the basis of the surface S that surrounds openings of the depressed portions of the surface in the electrophotographic photosensitive member.

The electrophotographic photosensitive member of the present invention is an electrophotographic photosensitive member the surface of which has the above depressed portions, which are depressed portions each having a ratio of depth (Rdv) to major-axis diameter (Rpc), Rdv/Rpc, of from more than 1.0 to 7.0 or less. This shows that it is an electrophotographic photosensitive member the surface of which has depressed portions each having a larger depth than the major-axis diameter.

The depressed portions in the present invention are formed at least on the surface of the electrophotographic photosensitive member. The region of depressed portions on the photosensitive member surface may be the whole region of the photosensitive member surface, or may be formed at some part of the surface. In order to achieve a good cleaning performance, it is preferable for the depressed portions to be formed at least at the surface portion coming into contact with the cleaning blade.

The use of the electrophotographic photosensitive member of the present invention can well maintain the cleaning performance and keep various image defects from coming about. The reason therefor has not clearly been understood. Such effect is considered due to the fact that the electrophotographic photosensitive member having on its surface the depressed portions having a larger depth than the major-axis diameter brings a low frictional resistance. Stated in detail, the frictional resistance between the electrophotographic photosensitive member and the cleaning blade shows a tendency to decrease with a decrease in contact area as the electrophotographic photosensitive member has an unevenness profile on its surface. However, since the cleaning blade itself is an elastic member, it is considered that the blade follows up the surface profile of the electrophotographic photosensitive member to a certain extent. Accordingly, it is considered that, where its surface profile is not appropriate, no sufficient effect may be brought out. In the electrophotographic photosensitive member of the present invention, the electrophotographic photosensitive member has on its surface the depressed portions having a larger depth than the major-axis diameter, and it is considered that the cleaning blade shows a tendency that it can be kept from following up the surface profile of the electrophotographic photosensitive member and this achieves a dramatically low frictional resistance between the electrophotographic photosensitive member and the cleaning blade. As the result, the cleaning performance is improved and a good cleaning performance is maintained not only at the initial stage but also during long-term service, and hence various image defects can be kept from coming about, as so considered.

The electrophotographic photosensitive member of the present invention can have a very small coefficient of friction between the electrophotographic photosensitive member and the cleaning blade as stated above, and this is considered to make a good cleaning performance maintained even though a developer is not sufficiently held between them. Further, the electrophotographic photosensitive member of the present invention has on its surface the depressed portions each having a larger depth than the major-axis diameter. This can make developer components such as toner or external additives retained in the depressed portions, and this is also considered to contribute to good cleaning performance.

Though details are unclear, good cleaning performance is commonly considered to be a state having been brought out because of the fact that the developer components such as toner or external additives having remained on the photosensitive member surface without being transferred therefrom are present between the cleaning blade and the electrophotographic photosensitive member. That is, in the background art, the cleaning performance is considered to be exhibited by utilizing part of the developer having remained without being transferred. Thus, depending on increase or decrease of the developer components having remained without being transferred, problems such as melt adhesion caused by the developer components having remained and an increase in frictional resistance may come about in some cases.

Stated more specifically, good cleaning performance has been exhibited where the developer components such as toner or external additives having remained without being transferred are sufficiently in a large quantity. However, the frictional resistance between the cleaning blade and the electrophotographic photosensitive member tends to increase when, e.g., a pattern having a low print density is printed in a large volume and when, e.g., monochrome printing is continuously performed in a tandem type electrophotographic system. As the result, the developer components tend to melt-adhere to them. This is considered due to the fact that the developer components such as toner or external additives present between the cleaning blade and the electrophotographic photosensitive member are in an extremely small quantity. As a countermeasure therefor, the electrophotographic photosensitive member of the present invention has on its surface the depressed portions each having a larger depth than the major-axis diameter. This can make the developer components such as toner or external additives retained in the depressed portions, and this is also considered to contribute to good cleaning performance. Thus, any difficulty in cleaning is considered not to easily come about even when a pattern having a low print density is printed in a large volume and when monochrome printing is continuously performed in a tandem type electrophotographic system.

The electrophotographic photosensitive member of the present invention may preferably have on its surface the depressed portions each having a ratio of depth to major-axis diameter, Rdv/Rpc, of from more than 1.0 to 7.0 or less, in a number of from 50 or more to 70,000 or less in 100 μm square of the electrophotographic photosensitive member surface. Making such specific depressed portions present in a large number per unit area brings an electrophotographic photosensitive member having a good cleaning performance. It may further preferably have the depressed portions each having a ratio of depth to major-axis diameter, Rdv/Rpc, of from more than 1.0 to 7.0 or less, in a number of from 100 or more to 50,000 or less in 100 μm square of the electrophotographic photosensitive member surface. It may also have, in unit area, depressed portions or hollows other than the depressed portions each having a ratio of depth to major-axis diameter, Rdv/Rpc, of from more than 1.0 to 7.0 or less. Here, as to the region of 100 μm square, the surface of the electrophotographic photosensitive member is equally divided into 4 regions in the rotational direction of the photosensitive member, which are then equally divided into 25 regions in the direction falling at right angles with the rotational direction of the photosensitive member to obtain 100 regions in total, and, in each of these regions, square regions of 100 μm each per one side are provided to make measurement.

On the surface of the electrophotographic photosensitive member, the ratio of i) average depth (Rdv-A) found by measuring depths of all depressed portions embraced in the region of 100 μm square and calculating their average to ii) average major-axis diameter (Rpc-A) found by measuring major-axis diameters of all depressed portions embraced in the region of 100 μm square and calculating their average, Rdv-A/Rpc-A, may be from more than 1.0 to 7.0 or less. This is preferable in view of good cleaning performance. Further, the ratio of the average depth (Rdv-A) to the average major-axis diameter (Rpc-A), Rdv-A/Rpc-A, may be from 1.3 or more to 5.0 or less. This is preferable in view of good cleaning performance.

The depth (Rdv) of depressed portions in the electrophotographic photosensitive member of the present invention may be of any value within the range of the ratio of depth to major-axis diameter, Rdv/Rpc, of from more than 1.0 to 7.0 or less, but may be from more than 3.0 μm to 10.0 μm or less. This is preferable in view of good cleaning performance. The depth (Rdv) may further preferably be from 3.5 μm or more to 8.0 μm or less.

The average depth (Rdv-A) found by measuring depths of all depressed portions embraced in the region of 100 μm square of the electrophotographic photosensitive member surface of the present invention and calculating their average may be from more than 3.0 μm to 10.0 μm or less. This is preferable in view of good cleaning performance. The average depth (Rdv-A) may further preferably be from 3.5 μm or more to 8.0 μm or less.

The major-axis diameter (Rpc) of depressed portions in the electrophotographic photosensitive member of the present invention may preferably be from more than 3.0 μm to 10.0 μm or less. The major-axis diameter (Rpc) may further preferably be from 3.5 μm or more to 8.0 μm or less.

The average major-axis diameter (Rpc-A) found by measuring major-axis diameters of all depressed portions embraced in the region of 100 μm square of the electrophotographic photosensitive member surface of the present invention and calculating their average may be from 0.1 μm or more to 10.0 μm or less. This is preferable in view of good cleaning performance. The average major-axis diameter (Rpc-A) may further preferably be from 0.5 μm or more to 8.0 μm or less.

The depressed portions each having a ratio of depth to major-axis diameter, Rdv/Rpc, of from more than 1.0 to 7.0 or less in the surface of the electrophotographic photosensitive member of the present invention may be of any arrangement. Stated in detail, the depressed portions each having a ratio of depth to major-axis diameter, Rdv/Rpc, of from more than 1.0 to 7.0 or less may be arranged at random, or may be arranged with regularity. In order to improve surface uniformity to cleaning performance, it is preferable for the depressed portions to be arranged with regularity.

In the present invention, the depressed portions of the surface of the electrophotographic photosensitive member may be observed on a commercially available laser microscope, optical microscope, electron microscope or atomic force microscope.

As the laser microscope, the following equipment may be used, for example. An ultradepth profile measuring microscope VK-8550, an ultradepth profile measuring microscope VK-9000 and an ultradepth profile measuring microscope VK-9500 (all manufactured by Keyence Corporation), a profile measuring system SURFACE EXPLORER SX-520DR model instrument (manufactured by Ryoka Systems Inc.), a scanning confocal laser microscope OLS3000 (manufactured by Olympus Corporation), and a real-color confocal microscope OPTELICS C130 (manufactured by Lasertec Corporation).

As the optical microscope, the following equipment may be used, for example. A digital microscope VHX-500 and a digital microscope VHX-2000 (both manufactured by Keyence Corporation) and a 3D digital microscope VC-7700 (manufactured by Omron Corporation).

As the electron microscope, the following equipment may be used, for example. A 3D real surface view microscope VE-9800 and a 3D real surface view microscope VE-8800 (both manufactured by Keyence Corporation), a scanning electron microscope Conventional/Variable Pressure System SEM (manufactured by SII Nano Technology Inc.), and a scanning electron microscope SUPER SCAN SS-550 (manufactured by Shimadzu Corporation).

As the atomic force microscope, the following equipment may be used, for example. A nanoscale hybrid microscope VN-8000 (manufactured by Keyence Corporation), a scanning probe microscope NanoNavi Station (manufactured by SII Nano Technology Inc.), and a scanning probe microscope SPM-9600 (manufactured by Shimadzu Corporation).

Using the above microscope, the major-axis diameter and depth of depressed portions in the measurement visual field may be observed at stated magnifications to measure these. Further, the area percentage of openings of depressed portions per unit area may be found by calculation.

Measurement with Surface Explorer SX-520DR model instrument, making use of an analytical program, is described as an example. A measuring object electrophotographic photosensitive member is placed on a work stand. The tilt is adjusted to bring the stand to a level, where three-dimensional profile data of the peripheral surface of the electrophotographic photosensitive member are entered in the analyzer in a wave mode. Here, the objective lens may be set at 50 magnifications under observation in a visual field of 100 μm×100 μm (10,000 $\mu m^2$). By this method, the surface of the measuring object photosensitive member is equally divided into 4 regions in the rotational direction of the photosensitive member, which are then equally divided into 25 regions in the direction falling at right angles with the rotational direction of the photosensitive member to obtain 100 regions in total, and, in each of these regions, square regions of 100 μm each per one side are provided to make measurement.

Next, contour line data of the surface of the electrophotographic photosensitive member are displayed by using a particle analytical program set in the data analytical software.

Hole analytical parameters of depressed portions, such as the profile, major-axis diameter, depth and opening area of the depressed portions may each be optimized according to the depressed portions formed. For example, where depressed portions of about 10 μm in major-axis diameter are observed and measured, the upper limit of major-axis diameter may be set at 15 μm, the lower limit of major-axis diameter at 1 μm, the lower limit of depth at 0.1 μm and the lower limit of volume at 1 $\mu m^3$ or more. Then, the number of depressed portions distinguishable as depressed portions on an analytical picture is counted, and the resultant value is regarded as the number of the depressed portions.

Under the same visual field and analytical conditions as the above, the total opening area of the depressed portions may be calculated from the total of opening area of respective depressed portions that is found by using the above particle analytical program, and the opening area percentage of depressed portions (hereinafter, what is simply noted as area percentage refers to this opening area percentage) may be calculated according to the following expression.

[(Total opening area of depressed portions)/(total opening area of depressed portions+total area of non-depressed-portions)]×100(%).

Incidentally, as to depressed portions of about 1 μm in major-axis diameter, these may be measured with the laser microscope and the optical microscope. However, where measurement precision should be more improved, it is desirable to use observation and measurement with the electron microscope in combination.

How to process the surface of the electrophotographic photosensitive member according to the present invention is described next.

As methods for forming surface profiles, there are no particular limitations as long as they are methods that can satisfy the above requirements concerned with the depressed portions. To give examples of how to process the surface of the electrophotographic photosensitive member, available are a method of processing the surface of the electrophotographic photosensitive member by irradiation with a laser having as its output characteristics a pulse width of 100 ns (nanoseconds) or less, a method of processing the surface by bringing a mold having a stated surface profile into pressure contact with the surface of the electrophotographic photosensitive member to effect surface profile transfer, and a method of processing the surface by causing condensation to take place on the surface of the electrophotographic photosensitive member when its surface layer is formed.

The method of processing the surface of the electrophotographic photosensitive member by irradiation with a laser having as its output characteristics a pulse width of 100 ns (nanoseconds) or less is described first. As examples of the laser used in this method, it may include an excimer laser making use of a gas such as ArF, KrF, XeF or XeCl as a laser medium, and a femtosecond laser making use of titanium sapphire as a laser medium. Further, the laser light in the above laser irradiation may preferably have a wavelength of 1,000 nm or less.

The excimer laser is a laser from which the light is emitted through the following steps. First, a mixed gas of a rare gas such as Ar, Kr or Xe and a halogen gas such as F or Cl is provided with high energy by discharge, electron beams or X-rays to excite and combine the above elements. Thereafter, the energy comes down to the ground state to cause dissociation, during which the excimer laser light is emitted. The gas used in the excimer laser may include ArF, KrF, XeCl and XeF, any of which may be used. In particular, KrF or ArF is preferred.

Figure 3:
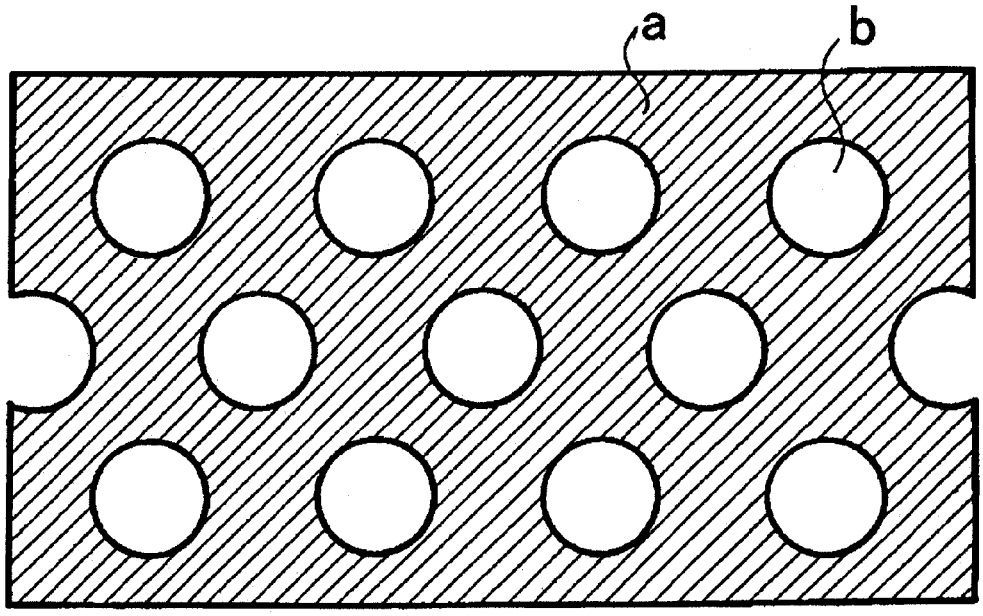
FIG. 3 is a view showing an example of an arrangement pattern of a mask (partial enlarged view) used in the present invention.
Figure 4:
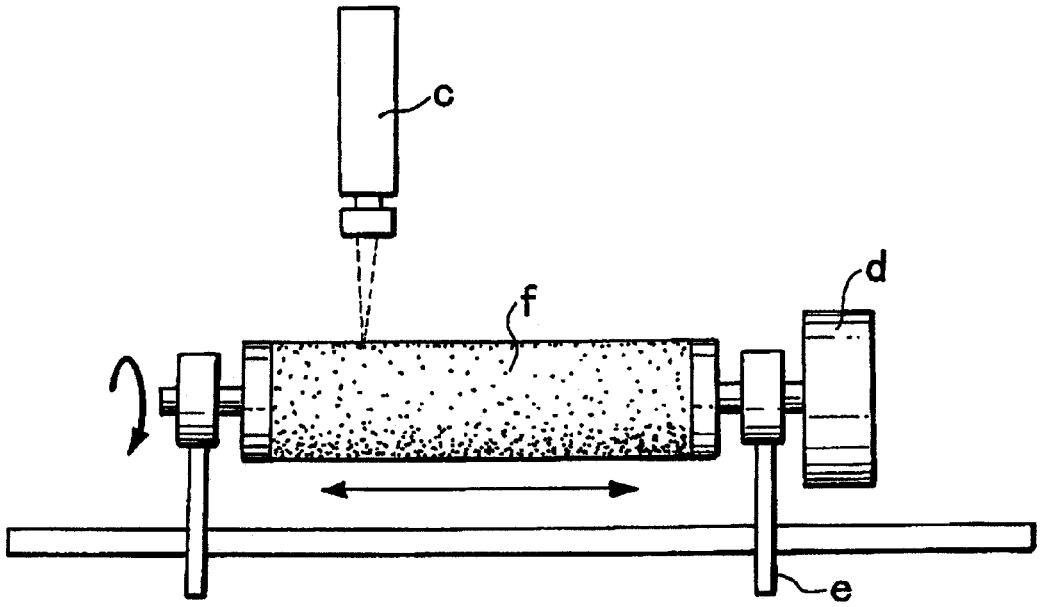
FIG. 4 is a schematic view showing an example of a laser surface processing unit used in the present invention.

As a method of forming the depressed portions, a mask is used in which laser light shielding areas a and laser light transmitting areas b are appropriately arranged as shown in FIG. 3. Only the laser light having been transmitted through the mask is converged with a lens, and the surface of the electrophotographic photosensitive member is irradiated with that light. This enables formation of the depressed portions having the desired shape and arrangement. In the above method of processing the surface of the electrophotographic photosensitive member by laser irradiation, surface processing can instantly and simultaneously be carried out to form a large number of depressed portions in a certain area, without regard to the shape and area of the depressed portions. Hence, the step of processing the surface can be carried out in a short time. By the laser irradiation making use of such a mask, the surface of the electrophotographic photosensitive member is processed in its region of from several $mm^2$ to several $cm^2$ per irradiation made once. In such laser processing, first, as shown in FIG. 4, an electrophotographic photosensitive member f is rotated by means of a work rotating motor d. With its rotation, the laser irradiation position of an excimer laser light irradiator c is shifted in the axial direction of the electrophotographic photosensitive member f. This enables formation of the depressed portions in a good efficiency over a wide range of the surface of the electrophotographic photosensitive member.

The above method of processing the surface of the electrophotographic photosensitive member by laser irradiation can produce the electrophotographic photosensitive member in which its surface layer has a plurality of depressed portions which are independent from one another, and, where the major-axis diameter of each depressed portion is represented by Rpc and the depth that shows the distance between the deepest part of each depressed portion and the opening thereof is represented by Rdv, the depressed portions each have a ratio of depth to major-axis diameter, Rdv/Rpc, of from more than 1.0 to 7.0 or less. The depressed portions may each have any depth within the above range. In the case when the surface of the electrophotographic photosensitive member is processed by laser irradiation, the depth of depressed portions may be controlled by adjusting production conditions such as time and number of times of laser irradiation. From the viewpoint of precision in manufacture or productivity, in the case when the surface of the electrophotographic photosensitive member is processed by laser irradiation, the depressed portions formed by irradiation made once may desirably be in a depth of from 0.1 μm or more to 2.0 μm or less, and preferably from 0.3 μm or more to 1.2 μm or less. The employment of the method of processing the surface of the electrophotographic photosensitive member by laser irradiation enables materialization of the surface processing of the electrophotographic photosensitive member in a high controllability for the size, shape and arrangement of the depressed portions, in a high precision and at a high degree of freedom.

Figure 5:
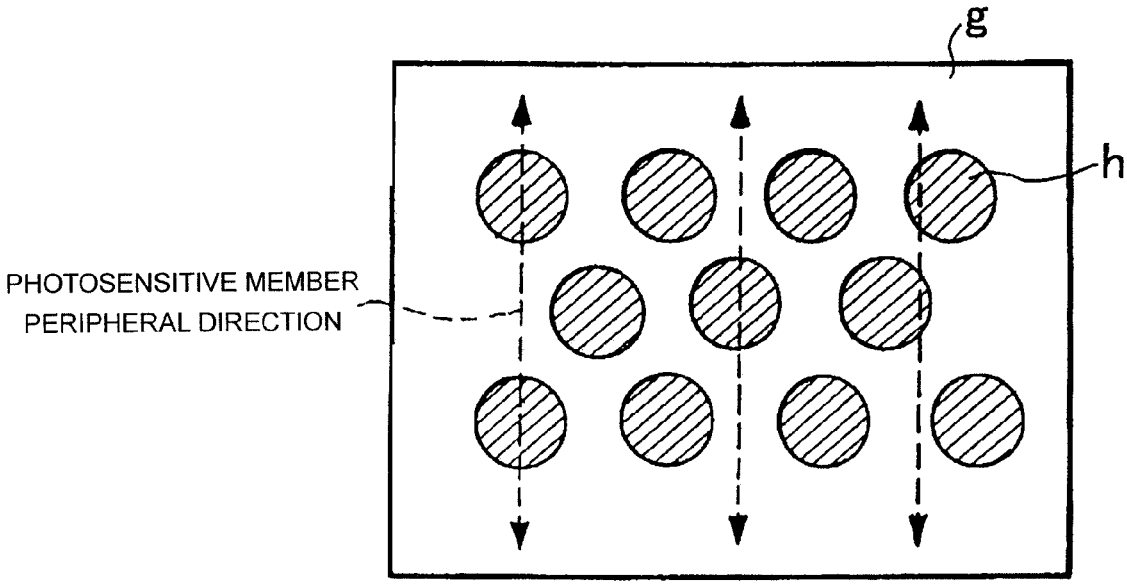
FIG. 5 is a view showing an example of an arrangement pattern of depressed portions (partial enlarged view) of the photosensitive member outermost surface obtained according to the present invention.

In the method of processing the surface of the electrophotographic photosensitive member by laser irradiation, the surface processing method may be applied to a plurality of surface portions or over the whole photosensitive member surface by using the same mask pattern. This way of processing enables formation of depressed portions with a high uniformity over the whole photosensitive member surface. As the result, the mechanical load to be applied to the cleaning blade when used in an electrophotographic apparatus can be uniform. Also, as shown in FIG. 5, the mask pattern may be so formed that both depressed portions h and no-depressed-portion-formed areas g are present on the lines (shown by arrows) of any peripheral directions of the photosensitive member surface. This enables more prevention of localization of the mechanical load to be applied to the cleaning blade.

The method of processing the surface by bringing a mold having a stated surface profile into pressure contact with the surface of the electrophotographic photosensitive member to effect surface profile transfer is described next.

Figure 6:
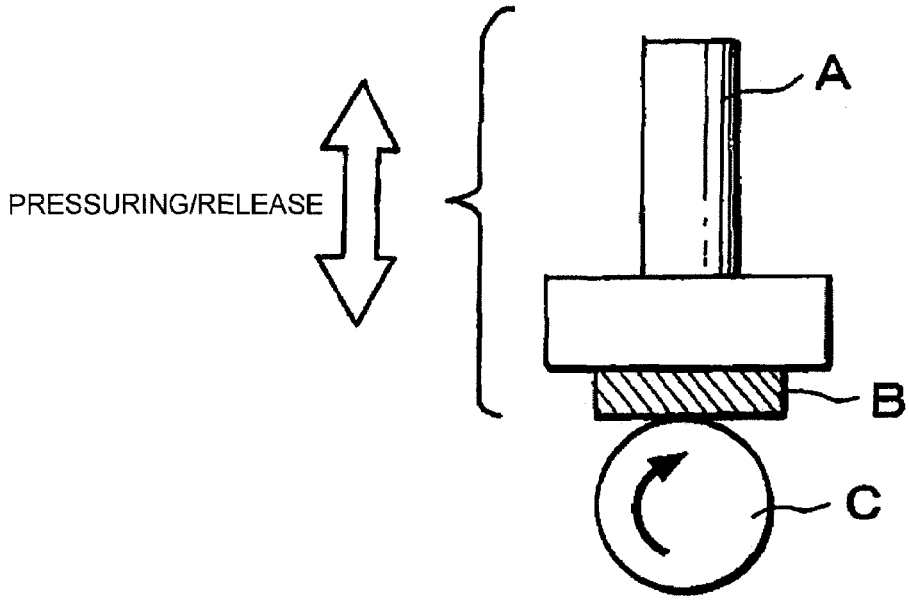
FIG. 6 is a schematic view showing an example of a pressure contact type profile transfer surface processing unit making use of a mold serving as a profile-providing material used in the present invention.

FIG. 6 is a schematic view showing an example of a pressure contact type profile transfer surface processing unit making use of a mold used in the present invention. A stated mold B is fitted to a pressuring unit A which can repeatedly perform pressuring and release, and thereafter brought into contact with an electrophotographic photosensitive member C at a stated pressure to effect transfer of a surface profile. Thereafter, the pressuring is first released to make the electrophotographic photosensitive member C rotated, and then pressuring is again performed to carry out the step of transferring the surface profile. Repeating this step enables formation of stated depressed portions over the whole peripheral surface of the electrophotographic photosensitive member.

Figure 7:
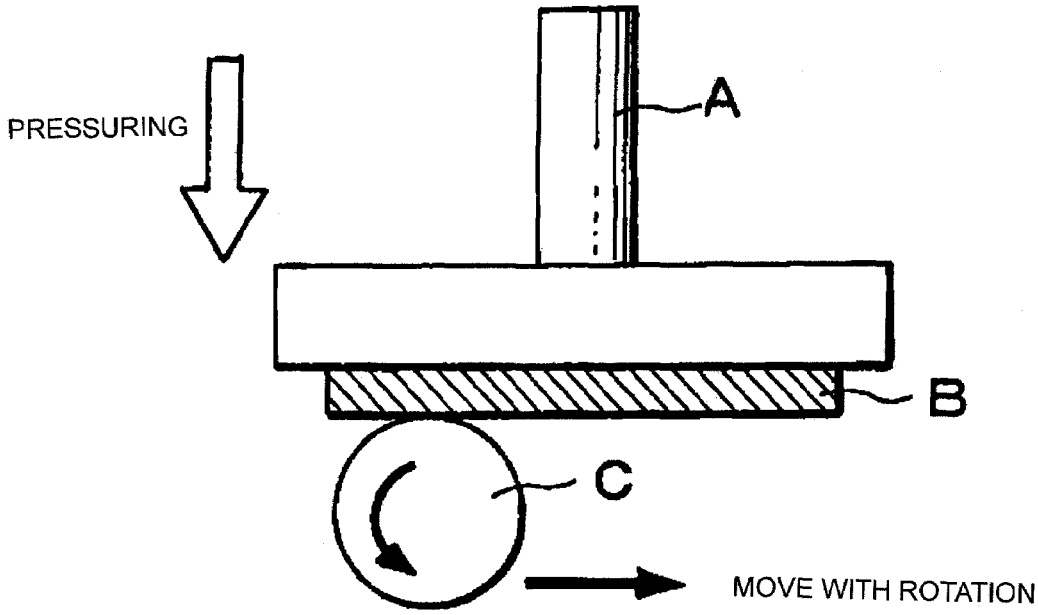
FIG. 7 is a view showing another example of a pressure contact type profile transfer surface processing unit making use of a mold used in the present invention.

Instead, as shown in FIG. 7 for example, a mold B having a stated surface profile with a length corresponding approximately to one circumference of the surface of electrophotographic photosensitive member C may be fitted to the pressuring unit A, and thereafter brought into contact with the electrophotographic photosensitive member C at a stated pressure, during which the electrophotographic photosensitive member is rotated (in the direction shown by an arrow) and moved (in the direction shown by another arrow) to form a stated depressed portions over the whole peripheral surface of the electrophotographic photosensitive member.

As another method, a sheetlike mold may be held between a roll-shaped pressuring unit and the electrophotographic photosensitive member to process the latter's surface while feeding the mold sheet.

For the purpose of effecting the surface profile transfer efficiently, the mold and the electrophotographic photosensitive member may be heated. The mold and the electrophotographic photosensitive member may be heated at any temperature as long as the surface profile of the present invention can be formed. They may preferably be so heated that the temperature (° C.) of the mold at the time of surface profile transfer may be higher than the glass transition temperature (° C.) of the photosensitive layer on the support of the electrophotographic photosensitive member. Further, in addition to the heating of the mold, the temperature (° C.) of the support at the time of surface profile transfer may be kept controlled to be lower than the glass transition temperature (° C.) of the photosensitive layer. This is preferable in order to stably form the depressed portions to be transferred to the electrophotographic photosensitive member surface.

Where the electrophotographic photosensitive member of the present invention is a photosensitive member having a charge transport layer, the mold may preferably be so heated that the temperature (° C.) of the mold at the time of surface profile transfer may be higher than the glass transition temperature (° C.) of the charge transport layer on the support. Further, in addition to the heating of the mold, the temperature (° C.) of the support at the time of surface profile transfer may be kept controlled to be lower than the glass transition temperature (° C.) of the charge transport layer. This is preferable in order to stably form the depressed portions to be transferred to the electrophotographic photosensitive member surface.

Figure 8A:
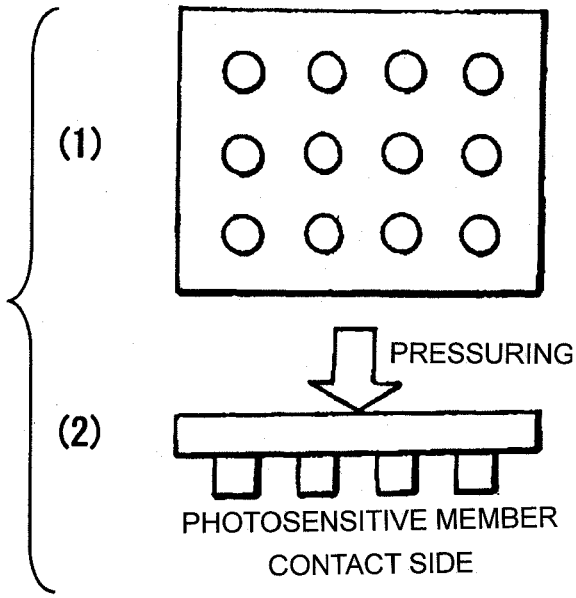
FIG. 8A is a view showing an example of a surface profile of the mold or profile-providing material used in the present invention, where a view (1) shows the surface profile of the mold as viewed from its top, and a view (2) shows the surface profile of the mold as viewed from its side.
Figure 8B:
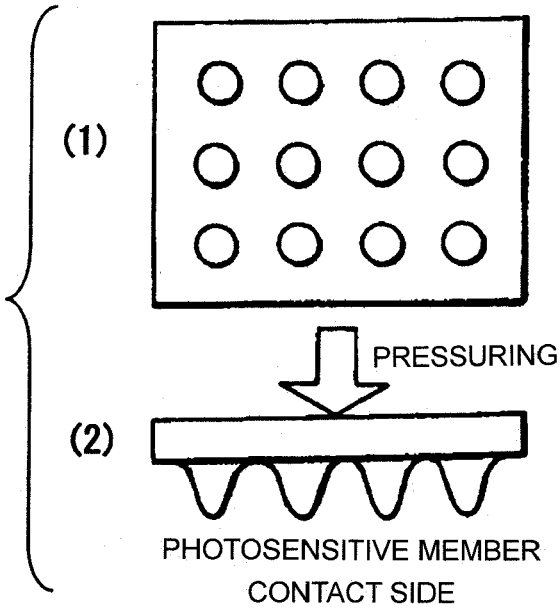
FIG. 8B, a view showing another example of a surface profile of the mold used in the present invention, where a view (1) shows the surface profile of the mold as viewed from its top, and a view (2) shows the surface profile of the mold as viewed from its side.

The material, size and surface profile of the mold itself may appropriately be selected. The material may include finely surface-processed metals and silicon wafers the surfaces of which have been patterned using a resist, and fine-particle-dispersed resin films or resin films having a stated fine surface profile which have been coated with a metal. Examples of the surface profile of the mold are shown in FIGS. 8A and 8B. In FIG. 8A, a view (1) shows the surface profile of the mold as viewed from its top, and a view (2) shows the surface profile of the mold as viewed from its side. In FIG. 8B as well, a view (1) shows the surface profile of the mold as viewed from its top, and a view (2) shows the surface profile of the mold as viewed from its side.

An elastic member may also be provided between the mold and the pressuring unit for the purpose of providing the electrophotographic photosensitive member with pressure uniformity.

The above method of processing the surface by bringing a mold having a stated surface profile into pressure contact with the surface of the electrophotographic photosensitive member to effect surface profile transfer can produce the electrophotographic photosensitive member in which its surface layer has a plurality of depressed portions which are independent from one another, and, where the major-axis diameter of each depressed portion is represented by Rpc and the depth that shows the distance between the deepest part of each depressed portion and the opening thereof is represented by Rdv, the depressed portions each have a ratio of depth to major-axis diameter, Rdv/Rpc, of from more than 1.0 to 7.0 or less. The depressed portions may each have any depth within the above range. In the case when the mold having a stated surface profile is brought into pressure contact with the surface of the electrophotographic photosensitive member to effect surface profile transfer, the depressed portions may desirably be in a depth of from 0.1 μm or more to 10 μm or less. The employment of the method of processing the surface by bringing a mold having a stated surface profile into pressure contact with the surface of the electrophotographic photosensitive member to effect surface profile transfer enables materialization of the surface processing of the electrophotographic photosensitive member in a high controllability for the size, shape and arrangement of the depressed portions, in a high precision and at a high degree of freedom.

The method of processing the surface by causing condensation to take place on the surface of the electrophotographic photosensitive member when its surface layer is formed is described next. The method of processing the surface by causing condensation to take place on the surface of the electrophotographic photosensitive member when its surface layer is formed is a method in which a surface layer coating solution containing a binder resin and a specific aromatic organic solvent and containing the aromatic organic solvent in an amount of from 50% by mass or more to 80% by mass or less based on the total mass of the solvent in the surface layer coating solution is prepared, and a surface layer on the surface of which the depressed portions independent from one another have been formed is produced through a coating step which coats a base member (the member as a base on which the surface layer is to be formed) with the coating solution, then a condensation step which holds the base member coated with the coating solution and causes condensation to take place on the surface of the base member coated with the coating solution, and thereafter a drying step which dries the base member on the surface of which the condensation has taken place.

The above binder resin may include, e.g., acrylic resins, styrene resins, polyester resins, polycarbonate resins, polyarylate resins, polysulfone resins, polyphenylene oxide resins, epoxy resins, polyurethane resins, alkyd resins and unsaturated resins. In particular, polymethyl methacrylate resins, polystyrene resins, styrene-acrylonitrile copolymer resins, polycarbonate resins, polyarylate resins and diallyl phthalate resins are preferred. Polycarbonate resins or polyarylate resins are further preferred. Any of these may be used alone, or in the form of a mixture or copolymer of two or more types.

The above specific aromatic organic solvent is a solvent having a low affinity for water. It may specifically include 1,2-dimethylbenzene, 1,3-dimethylbenzene, 1,4-dimethylbenzene, 1,3,5-trimethylbenzene and chlorobenzene.

It is important that the above surface layer coating solution contains the aromatic organic solvent. The surface layer coating solution may further contain an organic solvent having a high affinity for water, or water, for the purpose of forming the depressed portions stably. As the organic solvent having a high affinity for water, it may preferably be (methylsulfinyl) methane (popular name: dimethyl sufloxide), thiolan-1,1-dione (popular name: sulfolane), N,N-diemthylcarboxyamide, N,N-diethylcarboxyamide, dimethylacetamide or 1-mehylpyrrolidin-2-one. Any of these organic solvent may be contained alone or may be contained in the form of a mixture of two or more types.

The above condensation step which causes condensation to take place on the surface of the base member shows the step of holding the base member coated with the surface layer coating solution, for a certain time in an atmosphere in which the condensation takes place on the surface of the base member. The condensation in this surface processing method shows that droplets have been formed on the base member coated with the surface layer coating solution, by the action of the water. Conditions under which the condensation takes place on the surface of the base member are influenced by relative humidity of the atmosphere in which the base member is to be held and evaporation conditions (e.g., vaporization heat) for the coating solution solvent. However, the surface layer coating solution contains the aromatic organic solvent in an amount of 50% by mass or more based on the total mass of the solvent in the surface layer coating solution. Hence, the conditions under which the condensation occurs on the surface of the base member are less influenced by the evaporation conditions for the coating solution solvent, and depend chiefly on the relative humidity of the atmosphere in which the base member is to be held. The relative humidity at which the condensation is caused to take place on the surface of the base member may be from 40% to 100%. The relative humidity may further preferably be from 60% or more to 95% or less. Such a base member holding step may be given a time necessary for the droplets to be formed by the condensation. From the viewpoint of productivity, this time may preferably be from 1 second to 300 seconds, and may further preferably be approximately from 10 seconds to 180 seconds. The relative humidity is important for the base member holding step, and such an atmosphere may preferably have a temperature of from 20° C. or more to 80° C. or less.

Through the above drying step which dries the base member having been subjected to the condensation, the droplets produced on the surface through the base member holding step can be formed as the depressed portions of the photosensitive member surface. In order to form depressed portions with a high uniformity, it is important for the drying to be quick drying, and hence it is preferable to carry out heat drying. Drying temperature in the drying step may preferably be from 100° C. to 150° C. As the time for the drying step which dries the base member having been subjected to the condensation, a time may be given for which the solvent in the coating solution applied onto the base member and the droplets formed through the condensation step can be removed. The time for the drying step may preferably be from 20 minutes to 120 minutes, and may further preferably be from 40 minutes to 100 minutes.

By the above method of processing the surface by causing the condensation to take place on the surface of the electrophotographic photosensitive member when its surface layer is formed, the depressed portions independent from one another are formed on the surface of the electrophotographic photosensitive member. The method of processing the surface making use of the condensation on the surface of the electrophotographic photosensitive member when its surface layer is formed is a method in which the droplets to be formed by the action of water are formed using the solvent having a low affinity for water and the binder resin, to effect the condensation to form the depressed portions. The depressed portions formed on the surface of the electrophotographic photosensitive member produced by this production process are formed by the cohesive force of water, and hence they can individually have shapes of depressed portions with a high uniformity.

This production method is a production method which goes through the step of removing droplets, or removing droplets from a state that the droplets have sufficiently grown. Hence, the depressed portions of the surface of the electrophotographic photosensitive member are depressed portions formed in the shape of droplets or in the shape of honeycombs (hexagonal shape). The depressed portions in the shape of droplets refer to depressed portions looking, e.g., circular or elliptic in observation of the photosensitive member surface and depressed portions looking, e.g., partially circular or partially elliptic in observation of the photosensitive member cross section. The depressed portions in the shape of honeycombs (hexagonal shape) are, e.g., depressed portions formed as a result of closest packing of droplets on the surface of the electrophotographic photosensitive member. Stated specifically, they refer to depressed portions looking circular, hexagonal or hexagonal with round corners in observation of the photosensitive member surface and depressed portions looking, e.g., partially circular or square pillared in observation of the photosensitive member cross section.

The method of processing the surface by the condensation on the surface of the electrophotographic photosensitive member when its surface layer is formed can produce the electrophotographic photosensitive member in which its surface layer has a plurality of depressed portions which are independent from one another, and, where the major-axis diameter of each depressed portion is represented by Rpc and the depth that shows the distance between the deepest part of each depressed portion and the opening thereof is represented by Rdv, the depressed portions each have a ratio of depth to major-axis diameter, Rdv/Rpc, of from more than 1.0 to 7.0 or less. The depressed portions may each have any depth within the above range. Production conditions may preferably be so set that individual depressed portions may have a depth of from 0.5 μm or more to 10 μm or less, more preferably from more than 3.0 μm to 10.0 μm or less, and still more preferably from 3.5 μm or more to 8.0 μm or less.

The above depressed portions are controllable by adjusting production conditions within the range shown in the above production method. The depressed portions are controllable by selecting, e.g., the type of the solvent in the surface layer coating solution, the content of the solvent, the relative humidity in the condensation step, the retention time in the condensation step, and the drying temperature, which are prescribed in the present invention.

Construction of the electrophotographic photosensitive member according to the present invention is described next.

The electrophotographic photosensitive member of the present invention has, as mentioned previously, a support and an organic photosensitive layer (hereinafter also simply "photosensitive layer") provided on the support. The electrophotographic photosensitive member according to the present invention may commonly be a cylindrical organic electrophotographic photosensitive member in which the photosensitive layer is formed on a cylindrical support, which is in wide use, and may also be one having the shape of a belt or sheet.

The photosensitive layer may be either of a single-layer type photosensitive layer which contains a charge transporting material and a charge generating material in the same layer and a multi-layer type (function-separated type) photosensitive layer which is separated into a charge generation layer containing a charge generating material and a charge transport layer containing a charge transporting material. From the viewpoint of electrophotographic performance, the electrophotographic photosensitive member according to the present invention may preferably be one having the multi-layer type photosensitive layer. The multi-layer type photosensitive layer may also be either of a regular-layer type photosensitive layer in which the charge generation layer and the charge transport layer are superposed in this order from the support side and a reverse-layer type photosensitive layer in which the charge transport layer and the charge generation layer are superposed in this order from the support side. In the electrophotographic photosensitive member according to the present invention, where the multi-layer type photosensitive layer is employed, it may preferably be the regular-layer type photosensitive layer from the viewpoint of electrophotographic performance. The charge generation layer may be formed in multi-layer structure, and the charge transport layer may also be formed in multi-layer structure. A protective layer may further be provided on the photosensitive layer for the purpose of, e.g., improving running performance.

As the support, it may preferably be one having conductivity (conductive support). For example, usable are supports made of a metal such as aluminum, aluminum alloy or stainless steel. In the case of aluminum or aluminum alloy, usable are an ED pipe, an EI pipe and those obtained by subjecting these pipes to cutting, electrolytic composite polishing (electrolysis carried out using i) an electrode having electrolytic action and ii) an electrolytic solution, and polishing carried out using a grinding stone having polishing action) or to wet-process or dry-process honing. Still also usable are the above supports made of a metal, or supports made of a resin (such as polyethylene terephthalate, polybutylene terephthalate, phenol resin, polypropylene or polystyrene resin), and having layers film-formed by vacuum deposition of aluminum, an aluminum alloy or an indium oxide-tin oxide alloy. Still also usable are supports formed of resin or paper impregnated with conductive particles such as carbon black, tin oxide particles, titanium oxide particles or silver particles, and supports made of a plastic containing a conductive binder resin.

For the purpose of prevention of interference fringes caused by scattering of laser light or the like, the surface of the support may be subjected to cutting, surface roughening or aluminum anodizing.

The support may preferably have, where the surface of the support is a layer provided in order to impart conductivity, such a layer may have, a volume resistivity of from $1\times10$ Ω·cm or less, and, in particular, more preferably $1\times10^6$ Ω·cm or less.

A conductive layer intended for the prevention of interference fringes caused by scattering of laser light or the like or for the covering of scratches of the support surface may be provided between the support and an intermediate layer described later or the photosensitive layer (charge generation layer or charge transport layer). This is a layer formed by coating the support with a coating fluid prepared by dispersing a conductive powder in a suitable binder resin.

Such a conductive powder may include the following: Carbon black, acetylene black, metallic powders of, e.g., aluminum, nickel, iron, nichrome, copper, zinc and silver, and metal oxide powders such as conductive tin oxide and ITO.

The binder resin used simultaneously may include the following thermoplastic resins, thermosetting resins or photocurable resins: Polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyarylate resins, phenoxy resins, polycarbonate, cellulose acetate resins, ethyl cellulose resins, polyvinyl butyral, polyvinyl formal, polyvinyltoluene, poly-N-vinyl carbazol, acrylic resins, silicone resins, epoxy resins, melamine resins, urethane resins, phenol resins and alkyd resins.

The conductive layer may be formed by coating a coating fluid prepared by dispersing or dissolving the above conductive powder and binder resin in an ether type solvent such as tetrahydrofuran or ethylene glycol dimethyl ether, an alcohol type solvent such as methanol, a ketone type solvent such as methyl ethyl ketone, or an aromatic hydrocarbon solvent such as toluene. The conductive layer may preferably have an average layer thickness of from 0.2 μm or more to 40 μm or less, more preferably from 1 μm or more to 35 μm or less, and still more preferably from 5 μm or more to 30 μm or less.

The conductive layer with a conductive pigment or resistance control pigment dispersed therein shows a tendency that its surface comes roughened.

An intermediate layer having the function as a barrier and the function of adhesion may also be provided between the support or the conductive layer and the photosensitive layer (the charge generation layer or the charge transport layer). The intermediate layer is formed for the purposes of, e.g., improving the adherence of the photosensitive layer, improving coating performance, improving the injection of electric charges from the support and protecting the photosensitive layer from any electrical breakdown.

The intermediate layer may be formed by coating a curable resin and thereafter curing the resin to form a resin layer; or by coating on the conductive layer an intermediate layer coating fluid containing a binder resin, and drying the wet coating formed.

The binder resin for the intermediate layer may include the following: Water-soluble resins such as polyvinyl alcohol, polyvinyl methyl ether, polyacrylic acids, methyl cellulose, ethyl cellulose, polyglutamic acid and casein; and polyamide resins, polyimide resins, polyamide-imide resins, polyamic acid resins, melamine resins, epoxy resins, polyurethane resins, and polyglutamate resins. In order to bring out the electrical barrier properties effectively, and also from the viewpoint of coating properties, adherence, solvent resistance and electrical resistance, the binder resin for the intermediate layer may preferably be a thermoplastic resin. Stated specifically, a thermoplastic polyamide resin is preferred. As the polyamide resin, a low-crystalline or non-crystalline copolymer nylon is preferred as being able to be coated in the state of a solution. The intermediate layer may preferably have an average layer thickness of from 0.05 μm or more to 7 μm or less, and more preferably from 0.1 μm or more to 2 μm or less.

In the intermediate layer, semiconductive particles may be dispersed or an electron transport material (an electron accepting material such as an acceptor) may be incorporated, in order to make the flow of electric charges (carriers) not stagnate in the intermediate layer.

The photosensitive layer in the present invention is described next.

The charge generating material used in the electrophotographic photosensitive member of the present invention may include the following: Azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, and styryl dyes. Of these, particularly preferred are metal phthalocyanines such as oxytitanium phthalocyanine, hydroxygallium phthalocyanine and chlorogallium phthalocyanine, as having a high sensitivity.

In the case when the photosensitive layer is the multi-layer type photosensitive layer, the binder resin used to form the charge generation layer may include the following: Polycarbonate resins, polyester resins, polyarylate resins, butyral resins, polystyrene resins, polyvinyl acetal resins, diallyl phthalate resins, acrylic resins, methacrylic resins, vinyl acetate resins, phenol resins, silicone resins, polysulfone resins, styrene-butadiene copolymer resins, alkyd resins, epoxy resins, urea resins, and vinyl chloride-vinyl acetate copolymer resins. In particular, butyral resins are preferred. Any of these may be used alone or in the form of a mixture or copolymer of two or more types.

The charge generation layer may be formed by coating a charge generation layer coating fluid obtained by dispersing the charge generating material in the binder resin together with a solvent, and drying the wet coating formed. The charge generation layer may also be a vacuum-deposited film of the charge generating material. As a method for dispersion, a method is available which makes use of a homogenizer, ultrasonic waves, a ball mill, a sand mill, an attritor or a roll mill. The charge generating material and the binder resin may preferably be in a proportion ranging from 10:1 to 1:10 (mass ratio), and, in particular, more preferably from 3:1 to 1:1 (mass ratio).

The solvent used for the charge generation layer coating fluid may be selected taking account of the binder resin to be used and the solubility or dispersion stability of the charge generating material. As an organic solvent, it may include alcohol type solvents, sulfoxide type solvents, ketone type solvents, ether type solvents, ester type solvents and aromatic hydrocarbon solvents.

The charge generation layer may preferably be in an average layer thickness of 5 μm or less, and, in particular, more preferably from 0.1 μm to 2 μm.

A sensitizer, an antioxidant, an ultraviolet absorber and/or a plasticizer which may be of various types may also optionally be added to the charge generation layer. An electron transport material (an electron accepting material such as an acceptor) may also be incorporated in the charge generation layer in order to make the flow of electric charges (carriers) not stagnate in the charge generation layer.

The charge transporting material used in the electrophotographic photosensitive member of the present invention may include, e.g., triarylamine compounds, hydrazone compounds, styryl compounds, stilbene compounds, pyrazoline compounds, oxazole compounds, thiazole compounds, and triarylmethane compounds. Only one of any of these charge transporting materials may be used, or two or more types may be used.

The charge transport layer may be formed by coating a charge transport layer coating solution prepared by dissolving the charge transporting material and a binder resin in a solvent, and drying the wet coating formed. Also, of the above charge transporting materials, one having film forming properties alone may be film-formed alone without use of any binder resin to afford the charge transport layer.

In the case when the photosensitive layer is the multi-layer type photosensitive layer, the binder resin used to form the charge transport layer may include the following: Acrylic resins, styrene resins, polyester resins, polycarbonate resins, polyarylate resins, polysulfone resins, polyphenylene oxide resins, epoxy resins, polyurethane resins, alkyd resins and unsaturated resins. In particular, polymethyl methacrylate resins, polystyrene resins, styrene-acrylonitrile copolymer resins, polycarbonate resins, polyarylate resins and diallyl phthalate resins are preferred. Any of these may be used alone or in the form of a mixture or copolymer of two or more types.

The charge transport layer may be formed by coating a charge transport layer coating solution obtained by dissolving the charge transporting material and binder resin in a solvent, and drying the wet coating formed. The charge transporting material and the binder resin may preferably be in a proportion ranging from 2:1 to 1:2 (mass ratio).

The solvent used in the charge transport layer coating fluid may include the following: Ketone type solvents such as acetone and methyl ethyl ketone, ester type solvents such as methyl acetate and ethyl acetate, ether type solvents such as tetrahydrofuran, dioxolane, dimethoxymethane and dimethoxymethane, aromatic hydrocarbon solvents such as toluene, xylene and chlorobenzene. Any of these solvents may be used alone, or may be used in the form of a mixture of two or more types. Of these solvents, from the viewpoint of resin dissolving properties, it is preferable to use ether type solvents or aromatic hydrocarbon solvents.

The charge transport layer may preferably be in an average layer thickness of from 5 μm to 50 μm, and, in particular, more preferably from 10 μm to 35 μm.

An antioxidant, an ultraviolet absorber and/or a plasticizer for example may also optionally be added to the charge transport layer.

To improve running performance which is one of properties required in the electrophotographic photosensitive member in the present invention, material designing of the charge transport layer serving as a surface layer is important in the case of the above function-separated type photosensitive layer. For example, available are a method in which a binder resin having a high strength is used, a method in which the proportion of a charge-transporting material showing plasticity to the binder resin is made proper, and a method in which a high-molecular charge-transporting material is used. In order to more bring out the running performance, it is effective for the surface layer to be made up of a cure type resin.

As a method in which the surface layer is made up of such a cure type resin, for example, the charge transport layer may be made up of the cure type resin, or, on the charge transport layer, a cure type resin layer may be formed as a second charge transport layer or a protective layer. Properties required in the cure type resin layer are both film strength and charge-transporting ability, and such a layer is commonly made up of a charge-transporting material and a polymerizable or cross-linkable monomer or oligomer. As occasion calls, resistance-controlled conductive fine particles may also be used in order to provide the charge-transporting ability.

As a method in which such a surface layer is made up of the cure type resin, any known hole-transporting compound or electron-transporting compound may be used as the charge-transporting material. A material for synthesizing these compounds may include chain polymerization type materials having an acryloyloxyl group or a styrene group. It may also include successive polymerization type materials having a hydroxyl group, an alkoxysilyl group or an isocyanate group. From the viewpoints of electrophotographic performance, general-purpose properties, material designing and production stability of the electrophotographic photosensitive member the surface layer of which is made up of the cure type resin, it is preferable to use the hole-transporting compound and the chain polymerization type material in combination. Further, it is particularly preferable that the electrophotographic photosensitive member is one made up to have a surface layer formed by curing a compound having both the hole-transporting compound and the acryloyloxyl group in the molecule.

As a curing means, any known means may be used which makes use of heat, light or radiation.

Such a cured layer may preferably be, in the case of the charge transport layer, in an average layer thickness of from 5 μm or more to 50 μm or less, and more preferably from 10 μm or more to 35 μm or less. In the case of the second charge transport layer or protective layer, it may preferably be in an average layer thickness of from 0.1 μm or more to 20 μm or less, and still more preferably from 1 μm or more to 10 μm or less.

Various additives may be added to the respective layers of the electrophotographic photosensitive member of the present invention. Such additive may include deterioration preventives such as an antioxidant, an ultraviolet absorber and a light stabilizer, and organic fine particles or inorganic fine particles. The deterioration preventives may include hindered phenol type antioxidants, hindered amine type light stabilizers, sulfur atom-containing antioxidants and phosphorus atom-containing antioxidants. The organic fine particles may include high-polymer resin particles such as fluorine atom-containing resin particles, fine polystyrene particles and polyethylene resin particles. The inorganic fine particles may include metal oxide particles such as silica particles and alumina particles.

The electrophotographic photosensitive member of the present invention has, as described above, the specific depressed portions on the surface of the electrophotographic photosensitive member. The depressed portions in the present invention acts effectively when applied to photosensitive members the surfaces of which can not easily wear.

The surface layer of the electrophotographic photosensitive member of the present invention may preferably have a modulus of elastic deformation of from 40% or more to 70% or less, more preferably from 45% or more to 65% or less, and still more preferably from 50% or more to 60% or less. The surface of the electrophotographic photosensitive member of the present invention may also preferably have a universal hardness value (HU) of from 140 $N/mm^2$ or more to 240 $N/mm^2$ or less, and more preferably from 150 $N/mm^2$ or more to 220 $N/mm^2$ or less.

In the present invention, the universal hardness value (HU) and the modulus of elastic deformation are values measured with a microhardness measuring instrument FISCHER SCOPE H100V (manufactured by Fischer Co.) in an environment of an atmospheric temperature of 25° C. and a relative humidity of 50%. This FISCHER SCOPE H100V is an instrument in which an indenter is brought into touch with a measuring object (the peripheral surface of the electrophotographic photosensitive member) and a load is continuously applied to this indenter, where the depth of indentation under application of the load is directly read to find the hardness continuously. In the present invention, a Vickers pyramid diamond indenter having angles of 136 degrees between the opposite faces is used as the indenter. The indenter is pressed against the peripheral surface of the electrophotographic photosensitive member to make measurement Last of load (final load) applied continuously to the indenter: 6 mN.

Time for which the state of application of the final load of 6 mN to the indenter is retained (retention time): 0.1 second.

Measurement is made at 273 spots.

Figure 9:
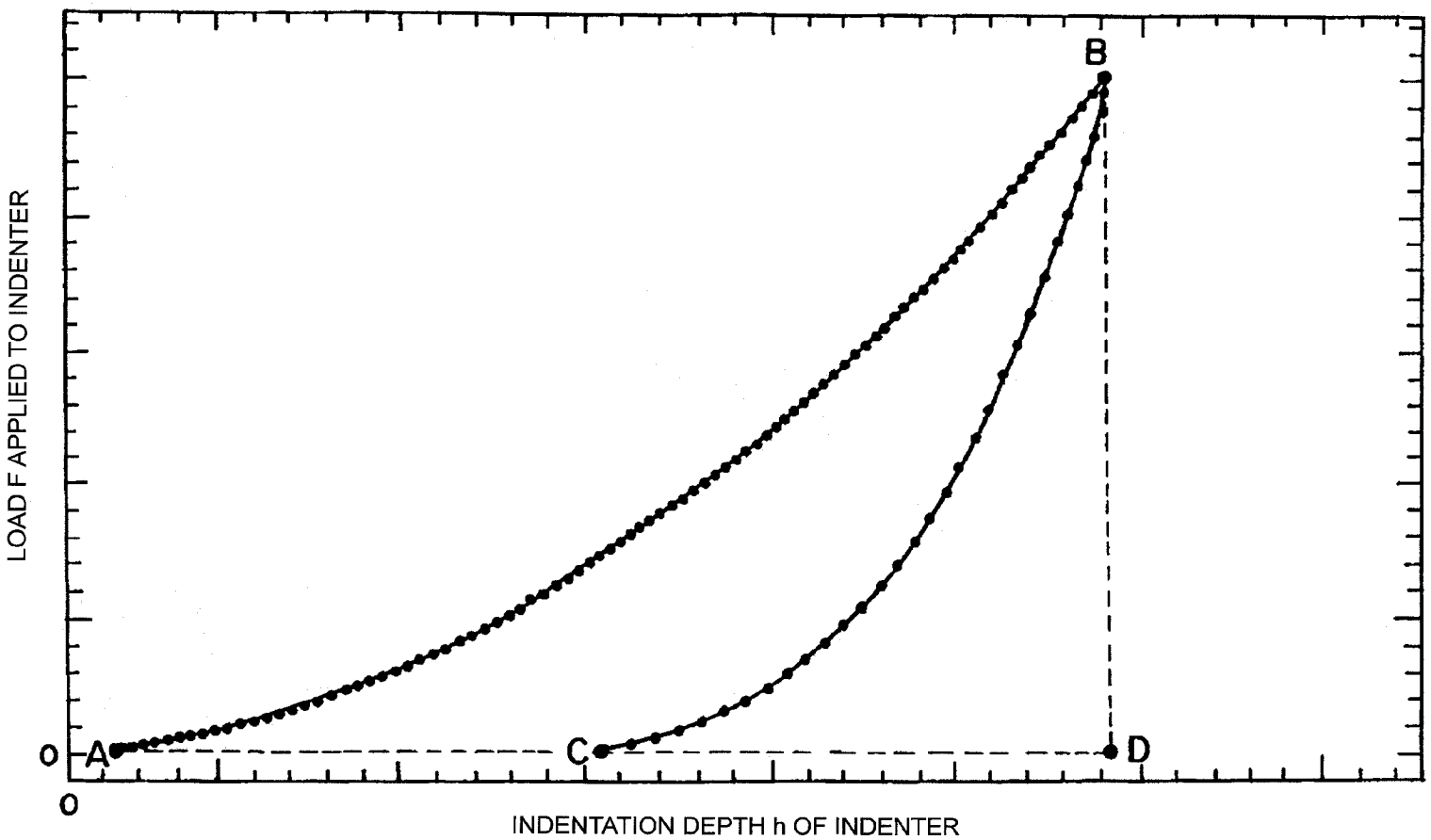
FIG. 9 is a graph showing an outline of an output chart of Fischer Scope H100V (manufactured by Fischer Co.).
Figure 10:
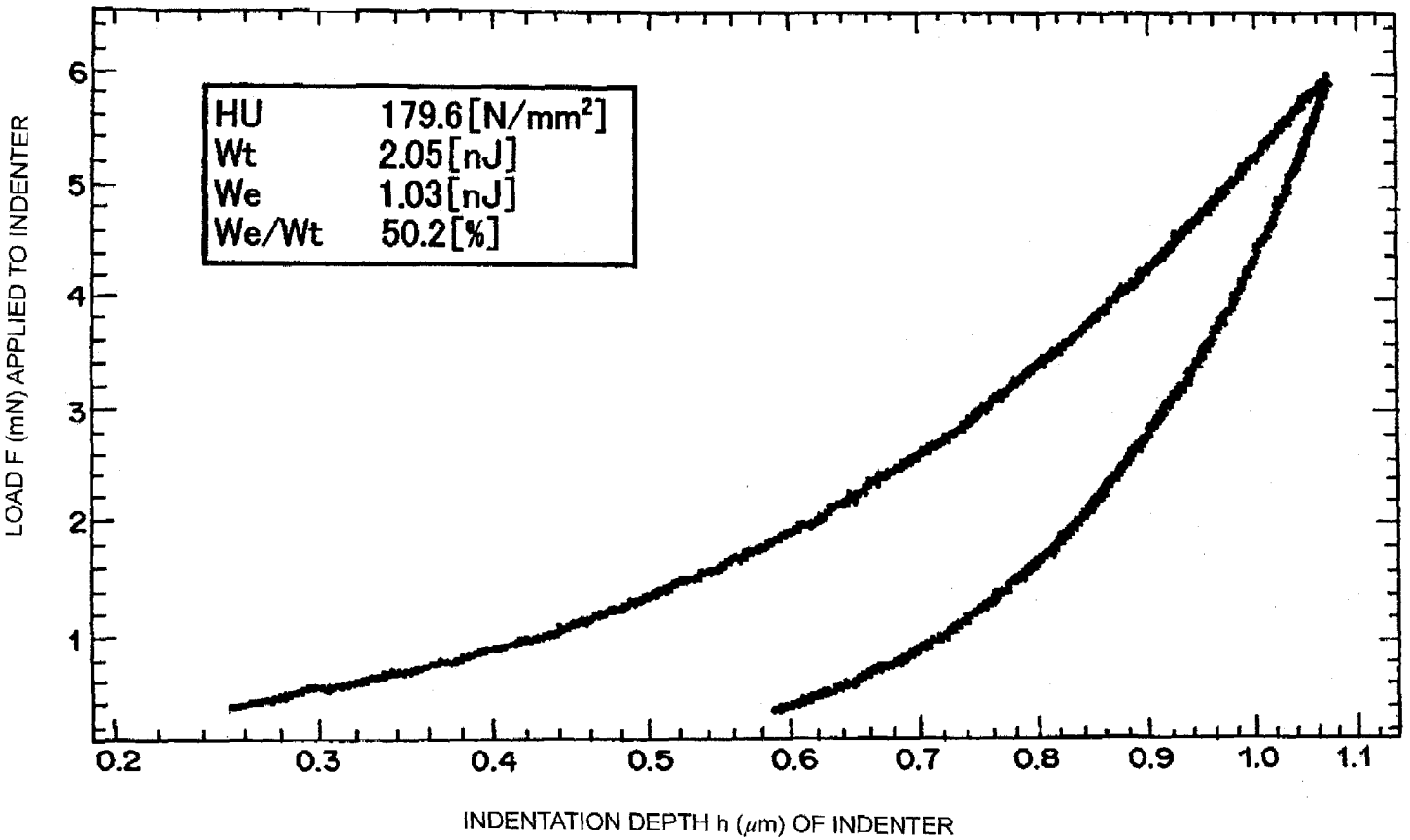
FIG. 10 is a graph showing an example of an output chart of Fischer Scope H100V (manufactured by Fischer Co.).

FIG. 9 is a graph showing an outline of an output chart of Fischer Scope H100V (manufactured by Fischer Co.). FIG. 10 is a graph showing an example of an output chart of Fischer Scope H100V (manufactured by Fischer Co.) where the electrophotographic photosensitive member according to the present invention is the measuring object. In FIGS. 9 and 10, the load F (mN) applied to the indenter is plotted as ordinate, and the depth of indentation h (μm) of the indenter as abscissa. FIG. 9 shows results obtained when the load F applied to the indenter is made to increase stepwise until the load comes maximum (from A to B), and thereafter the load is made to decrease stepwise (from B to C). FIG. 10 shows results obtained when the load applied to the indenter is made to increase stepwise until the load comes finally to be 6 mN, and thereafter the load is made to decrease stepwise.

The universal hardness value (HU) may be found from the depth of indentation at the time the final load of 6 mN is applied to the indenter, and according to the following expression. In the following expression, HU stands for the universal hardness, $F_f$ stands for the final load (unit N), $S_f$ stands for the surface area ($mm^2$) of the part where the indenter is indented under application of the final load, and $h_f$ stands for the indentation depth (mm) of the indenter at the time the final load is applied.

$$HU=F_f[N]/S_f[mm^2]=6\times10^{-3}/26.43\times(h_f\times10^{-3})^2.$$

The modulus of elastic deformation may be found from the work done (energy) by the indenter against the measuring object (the peripheral surface of the electrophotographic photosensitive member), i.e., the changes in energy that are due to increase and decrease of the load of the indenter against the measuring object (the peripheral surface of the electrophotographic photosensitive member). Stated specifically, the value found when the elastic deformation work done We is divided by the total work done Wt (We/Wt) is the modulus of elastic deformation. The total work done Wt is the area of a region surrounded by A-B-D-A in FIG. 9, and the elastic deformation work done We is the area of a region surrounded by C-B-D-C in FIG. 9.

When the above respective layers are coated, any coating method may be used, such as dip coating, spray coating, spinner coating, roller coating, Meyer bar coating, blade coating or ring coating.

Figure 11:
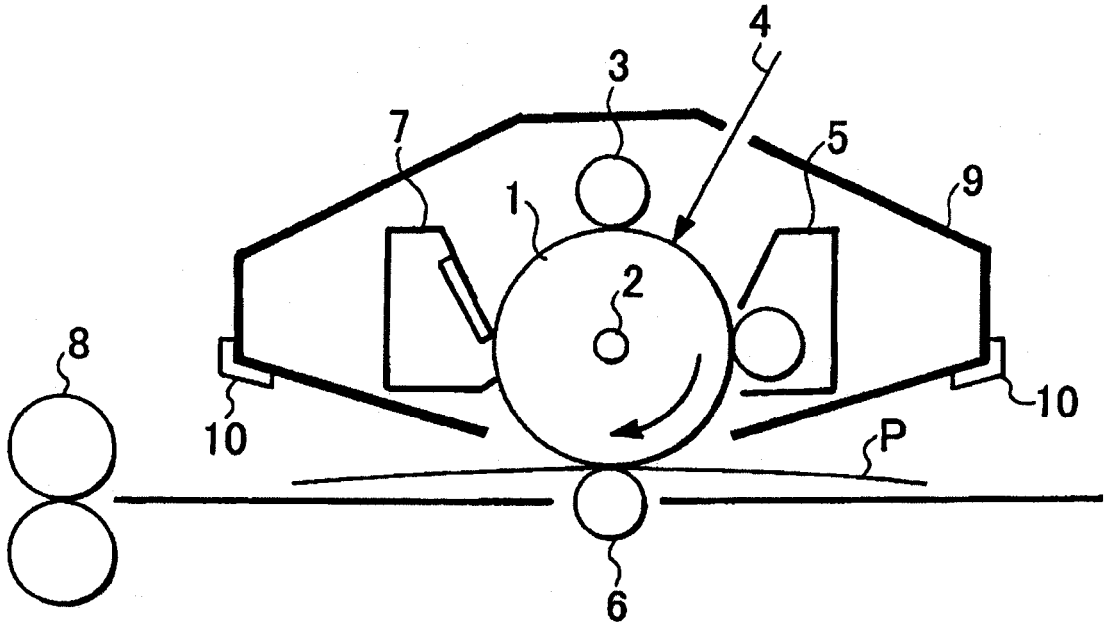
FIG. 11 is a schematic view showing an example of the construction of an electrophotographic apparatus provided with a process cartridge having the electrophotographic photosensitive member according to the present invention.

The process cartridge and electrophotographic apparatus according to the present invention are described next. FIG. 11 is a schematic view showing an example of the construction of an electrophotographic apparatus provided with a process cartridge having the electrophotographic photosensitive member of the present invention.

In FIG. 11, reference numeral 1 denotes a cylindrical electrophotographic photosensitive member, which is rotatingly driven around an axis 2 in the direction of an arrow at a stated peripheral speed.

The surface of the electrophotographic photosensitive member 1 rotatingly driven is uniformly electrostatically charged to a positive or negative, given potential through a charging device (primary charging device such as a charging roller) 3. The electrophotographic photosensitive member thus charged is then exposed to exposure light (imagewise exposure light) 4 emitted from an exposure device (not shown) for slit exposure, laser beam scanning exposure or the like. In this way, electrostatic latent images corresponding to the intended image are successively formed on the peripheral surface of the electrophotographic photosensitive member 1.

The electrostatic latent images thus formed on the surface of the electrophotographic photosensitive member 1 are developed with a toner contained in a developer a developing device 5 has, to form toner images. Then, the toner images thus formed and held on the surface of the electrophotographic photosensitive member 1 are successively transferred by applying a transfer bias from a transfer device (such as a transfer roller) 6, which are successively transferred on to a transfer material (such as paper) P fed from a transfer material feed means (not shown) to the part (contact zone) between the electrophotographic photosensitive member 1 and the transfer device 6 in the manner synchronized with the rotation of the electrophotographic photosensitive member 1.

The transfer material P to which the toner images have been transferred is separated from the peripheral surface of the electrophotographic photosensitive member 1 and led into a fixing means 8, where the toner images are fixed, and is then put out of the apparatus as an image-formed material (a print or a copy).

The peripheral surface of the electrophotographic photosensitive member 1 from which the toner images have been transferred is brought to removal of the developer (toner) remaining after the transfer, through a cleaning device (such as a cleaning blade) 7. Thus, its surface is cleaned. The surface of the electrophotographic photosensitive member 1 is further subjected to charge elimination by pre-exposure light (not shown) emitted from a pre-exposure device (not shown), and thereafter repeatedly used for the formation of images. Incidentally, where as shown in FIG. 11 the charging device 3 is the contact charging device making use of, e.g., a charging roller, the pre-exposure is not necessarily required.

The apparatus may be constituted of a combination of plural components integrally joined in a container as a process cartridge from among the constituents such as the above electrophotographic photosensitive member 1, charging device 3, developing device 5 and cleaning device 7. This process cartridge may also be so set up as to be detachably mountable to the main body of an electrophotographic apparatus such as a copying machine or a laser beam printer. In the apparatus shown in FIG. 11, the electrophotographic photosensitive member 1 and the charging device 3, developing device 5 and cleaning device 7 are integrally supported to form a cartridge to set up a process cartridge 9 that is detachably mountable to the main body of the electrophotographic apparatus through a guide means 10 such as rails provided in the main body of the electrophotographic apparatus.

EXAMPLES

The present invention is described below in greater detail by giving specific working examples. In the following Examples, "part(s)" is meant to be "part(s) by weight".

Example 1

An aluminum cylinder of 30 mm in diameter and 357.5 mm in length the surface of which stood worked by cutting was used as a support (cylindrical support).

Next, a mixture composed of the following components was subjected to dispersion for about 20 hours by means of a ball mill to prepare a conductive layer coating fluid.

| | |
|---|---|
| Powder composed of barium sulfate particles having coat layers of tin oxide (trade name: PASTRAN PC1; available from Mitsui Mining & Smelting Co., Ltd.) | 60 parts |
| Titanium oxide (trade name: TITANIX JR; available from Tayca Corporation) | 15 parts |
| Resol type phenolic resin (trade name: PHENOLITE J-325; available from Dainippon Ink & Chemicals, Incorporated; solid content: 70%) | 43 parts |
| Silicone oil (trade name: SH28PA; available from Toray Silicone Co., Ltd.) | 0.015 part |
| Silicone resin (trade name: TOSPEARL 120; available from Toshiba Silicone Co., Ltd.) | 3.6 parts |
| 2-Methoxy-1-propanol | 50 parts |
| Methanol | 50 parts |

The conductive layer coating fluid thus prepared was applied on the above support by dip coating, followed by heat curing for 1 hour in an oven heated to 140° C., to form a conductive layer with an average layer thickness of 15 μm at the position of 170 mm from the support upper end.

Next, an intermediate layer coating solution prepared by dissolving the following components in a mixed solvent of 400 parts of methanol and 200 parts of n-butanol was applied on the conductive layer by dip coating, followed by heat drying for 30 minutes in an oven heated to 100° C., to form an intermediate layer with an average layer thickness of 0.45 μm at the position of 170 mm from the support upper end.

| | |
|---|---|
| Copolymer nylon resin (trade name: AMILAN CM8000; available from Toray Industries, Inc.) | 10 parts |
| Methoxymethylated nylon 6 resin (trade name: TORESIN EF-30T; available from Teikoku Chemical Industry Co., Ltd.) | 30 parts |

Next, the following components were subjected to dispersion for 4 hours by means of a sand mill making use of glass beads of 1 mm in diameter, and then 700 parts of ethyl acetate was added to prepare a charge generation layer coating fluid.

| | |
|---|---|
| Hydroxygallium phthalocyanine (one having strong peaks at Bragg angles of 2θ plus-minus 0.2°, of 7.5°, 9.9°, 16.3°, 18.6°, 25.1° and 28.3° in CuKα characteristics X-ray diffraction) | 20 parts |
| Carixarene compound represented by the following structural formula (1) | 0.2 part |

(1)

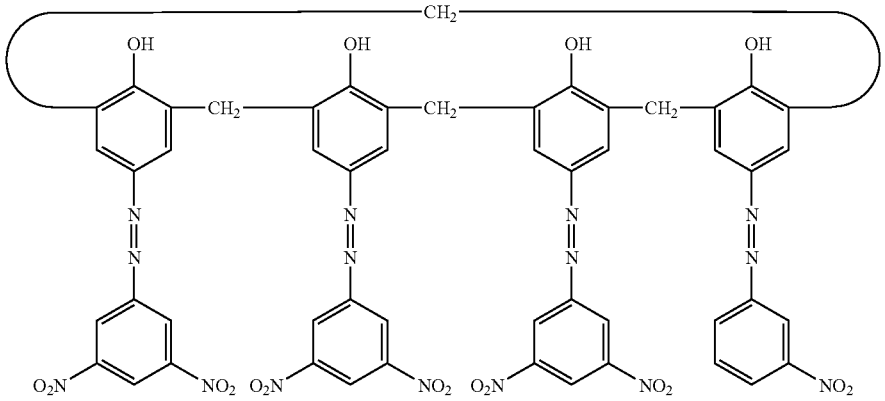

| | |
|---|---|
| Polyvinyl butyral (trade name: S-LEC BX-1, available from Sekisui Chemical Co., Ltd.) | 10 parts |
| Cyclohexanone | 600 parts |

The above charge generation layer coating fluid was applied on the intermediate layer by dip coating, followed by heat drying for 15 minutes in an oven heated to 80° C., to form a charge generation layer with an average layer thickness of 0.17 μm at the position of 170 mm from the support upper end.

Next, the following components were dissolved in a mixed solvent of 600 parts of chlorobenzene and 200 parts of methylal to prepare a charge transport layer coating solution. This first charge transport layer coating solution was applied on the charge generation layer by dip coating, followed by heat drying for 30 minutes in an oven heated to 100° C., to form a charge transport layer with an average layer thickness of 15 μm at the position of 170 mm from the support upper end.

| | |
|---|---|
| Charge transporting material (hole transporting material) represented by the following structural formula (2) | 70 parts |

(2)

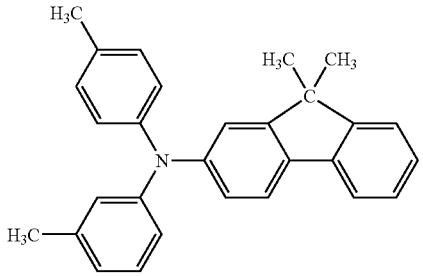

| | |
|---|---|
| Polycarbonate resin (trade name: IUPILON Z400; available from Mitsubishi Engineering-Plastics Corporation) | 100 parts |

Next, the following component was dissolved in a mixed solvent of 20 parts of 1,1,2,2,3,3,4-heptafluorocyclopentane (trade name: ZEOROLA H, available from Nippon Zeon Co., Ltd.) and 20 parts of 1-propanol.

| | |
|---|---|
| Fluorine atom-containing resin (trade name: GF-300, available from Toagosei Chemical Industry Co., Ltd.) | 0.5 part |

To the solution in which the above fluorine atom-containing resin was dissolved, 10 parts of tetrafluoroethylene resin powder (trade name: LUBRON L-2, available from Daikin Industries, Ltd.) was added. Thereafter, the solution to which the tetrafluoroethylene resin powder was added was treated four times under a pressure of 600 kgf/cm$^2$ by means of a high-pressure dispersion machine (trade name: MICROFLUIDIZER M-110EH, manufactured by Microfluidics Inc., USA) to effect uniform dispersion. The solution having been subjected to the above dispersion treatment was filtered with Polyfron filter (trade name: PF-040, available from Advantec Toyo Kaisha, Ltd.) to prepare a dispersion. Thereafter, 90 parts of a charge transporting material (hole transporting material) represented by the following structural formula (3):

(3)

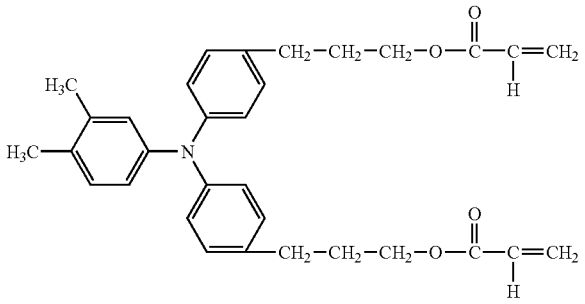

70 parts of 1,1,2,2,3,3,4-heptafluorocyclopentane and 70 parts of 1-propanol were added to the above dispersion. This was filtered with Polyfron filter (trade name: PF-020, available from Advantec Toyo Kaisha, Ltd.) to prepare a second charge transport layer coating solution.

Using this second charge transport layer coating solution, the second charge transport layer coating solution was applied on the charge transport layer by coating, followed by drying for 10 minutes in the atmosphere in an oven kept at 50° C. Thereafter, the layer formed was irradiated with electron rays for 1.6 seconds in an atmosphere of nitrogen and under conditions of an accelerating voltage of 150 kV and a beam current of 3.0 mA while rotating the support at 200 rpm. Subsequently, in an atmosphere of nitrogen, the temperature around the support was raised from 25° C. to 125° C. over a period of 30 seconds to carry out curing reaction of the substance contained in the second charge transport layer formed. Here, the absorbed dose of electron rays was measured to find that it was 15 KGy. Oxygen concentration in the atmosphere of electron ray irradiation and heat curing reaction was found to be 15 ppm or less. Thereafter, the support thus treated was naturally cooled to 25° C. in the atmosphere, and then subjected to heat treatment for 30 minutes in the atmosphere in an oven heated to 100° C., to form a protective layer with an average layer thickness of 5 μm at the position of 170 mm from the support upper end. Thus, an electrophotographic photosensitive member was obtained.

Figure 12:
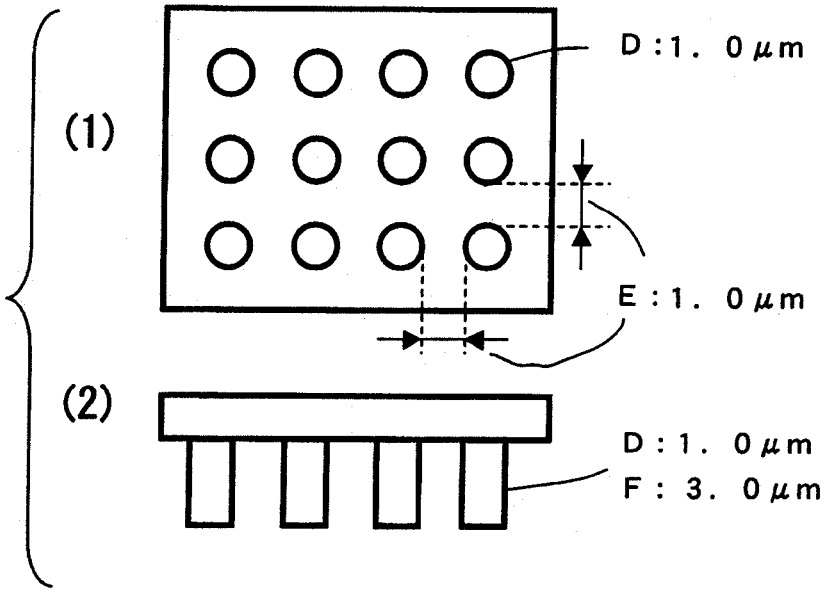
FIG. 12 is a view showing a surface profile of a mold (partial enlarged view) used in Example 1. A view (1) in FIG. 12 shows the surface profile of the mold as viewed from its top, and a view (2) shows the surface profile of the mold as viewed from its side.

The electrophotographic photosensitive member produced in the manner described above was subjected to surface processing by setting it in the pressure contact type profile transfer surface processing unit shown in FIG. 7, using a mold for surface profile transfer shown in FIG. 12. The temperatures of the electrophotographic photosensitive member and mold at the time of the surface processing was controlled at 110° C., and the electrophotographic photosensitive member was rotated in its peripheral direction with pressuring at a pressure of 5 MPa to perform surface profile transfer. In FIG. 12, a view (1) shows the surface profile of the mold as viewed from its top, and a view (2) shows the surface profile of the mold as viewed from its side. The mold shown in FIG. 12 has a column-shaped surface profile. Its columns each have a major-axis diameter D of 1.0 μm, a height F of 3.0 μm and a column-to-column interval E of 1.0 μm.

—Measurement of Surface Profile of Electrophotographic Photosensitive Member—

The surface of the electrophotographic photosensitive member produced in the manner described above was observed with an ultradepth profile measuring microscope VK-9500 (manufactured by Keyence Corporation). The measuring object electrophotographic photosensitive member was placed on a stand which was so worked that its cylindrical support was able to be fastened, where the surface of the electrophotographic photosensitive member was observed at the position of 170 mm distant from its upper end. Here, the objective lens was set at 50 magnifications under observation in a visual field of 100 μm square of the photosensitive member surface. The depressed portions observed in the visual field of measurement were analyzed by using the analytical program.

Figure 13:
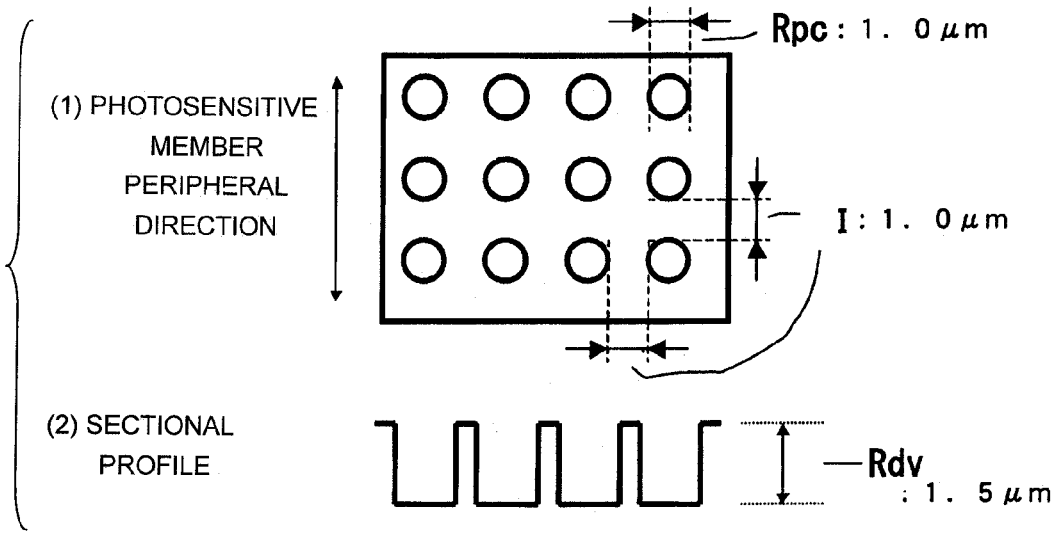
FIG. 13 is a view showing an arrangement pattern of depressed portions (partial enlarged view) of the photosensitive member outermost surface obtained according to Example 1. A view (1) in FIG. 13 shows how the depressed portions formed on the surface of the photosensitive member are arranged, and a view (2) shows a sectional profile of the depressed portions.

The shape of each depressed portion at its surface portion within the visual field of measurement, the major-axis diameter (Rpc) thereof and the depth (Rdv) that shows the distance between the deepest part of each depressed portion and the opening thereof were measured. It was ascertained that depressed portions having the shape of columns as shown in FIG. 13 stood formed on the surface of the electrophotographic photosensitive member. The number of depressed portions in 100 μm square which have the ratio of depth to major-axis diameter, Rdv/Rpc, of from more than 1.0 to 7.0 or less was counted to find that it was 2,500 depressions. The average major-axis diameter (Rpc-A) of depressed portions in 100 μm square was 1.0 μm. Average distance I between each depressed portion and a depressed portion present at a distance shortest from the former depressed portion (which may hereinafter also be termed "depressed portion interval") was 1.0 μm, at which interval the depressed portions stood formed. The average depth (Rdv-A) of depressed portions in 100 μm square was 1.5 μm. The area percentage was also further calculated to find that it was 20%. The results are shown in Table 1. (In Table 1, "Number" shows the number of depressed portions in 100 μm square which have the ratio of depth to major-axis diameter, Rdv/Rpc, of from more than 1.0 to 7.0 or less. "Rpc-A" stands for the average major-axis diameter of depressed portions present in 100 μm square. "Rdv-A" stands for the average depth of depressed portions present in 100 μm square. "Rdv-A/Rpc-A" stands for the ratio of average depth to average major-axis diameter of depressed portions present in 100 μm square).

—Measurement of Modulus of Elastic Deformation And Universal Hardness (HU) of Electrophotographic Photosensitive Member—

The electrophotographic photosensitive member produced in the manner described above was left for 24 hours in an environment of an atmospheric temperature of 23° C. and a relative humidity of 50%, and thereafter its modulus of elastic deformation and universal hardness were measured. As the result, the modulus of elastic deformation was found to be 55%, and the universal hardness 180 N/mm$^2$.

—Performance Evaluation of Electrophotographic Photosensitive Member—

The electrophotographic photosensitive member produced in the manner described above was fitted to an electrophotographic copying machine GP55 (corona charging system), manufactured by CANON INC., to make evaluation in the following way.

In an environment of an atmospheric temperature of 23° C. and a relative humidity of 50%, conditions of potential were so set that the dark-area potential (Vd) and light-area potential (Vl) of the electrophotographic photosensitive member came to be −700 V and −200 V, respectively, and the initial potential of the electrophotographic photosensitive member was adjusted.

Next, a cleaning blade made of polyurethane rubber was so set against the electrophotographic photosensitive member surface as to be 25° in contact angle and 30 g/cm in contact pressure.

Under the above evaluation conditions, the initial drive current value (current value A) of a motor for rotating the above surface-processed electrophotographic photosensitive member was measured. This evaluation is to evaluate the amount of a load produced between the electrophotographic photosensitive member and the cleaning blade. The magnitude of current value obtained shows the magnitude of the amount of a load between the electrophotographic photosensitive member and the cleaning blade. Further, using an electrophotographic photosensitive member obtained in the same manner as the above except that its surface was not processed, the initial drive current value (current value B) of a motor for rotating the surface-processed electrophotographic photosensitive member was measured. The ratio of the drive current value (current value A) of a motor for rotating the surface-processed electrophotographic photosensitive member to the drive current value (current value B) of a motor for rotating the surface-unprocessed electrophotographic photosensitive member, thus found, was calculated. The numerical value of (current value A)/(current value B) found was compared as a relative torque rate. The numerical value of this relative torque rate shows the extent of the amount of a load produced between the electrophotographic photosensitive member and the cleaning blade. It shows that, the smaller the numerical value of this relative torque rate is, the smaller the amount of a load produced between the electrophotographic photosensitive member and the cleaning blade is.

Thereafter, a 50,000-sheet paper feed running test was conducted under conditions of two-sheet intermittent feed of A4-size paper. Here, a chart having a print percentage of 5% was used as a test chart.

Evaluation was made on the blade chattering that reflects cleaning performance during running. The blade chattering shows a phenomenon that the electrophotographic photosensitive member makes a noise when the electrophotographic photosensitive member and the cleaning blade rub together, when the electrophotographic photosensitive member begins to be rotated or when the electrophotographic photosensitive member stops to be rotated. The chief cause of the blade chattering is considered to be high frictional resistance between the electrophotographic photosensitive member and the cleaning blade. The torque rate is used in the present invention in evaluating the frictional resistance between the electrophotographic photosensitive member and the cleaning blade. The results are shown in Table 1. (In Table 1, "Torque rate" shows the relative torque rate according to the above method. "Blade chattering in 50,000-sheet running" shows whether or not the blade chattering occurred in the paper feed running test according to the above method, or the number of sheet at which the blade chattering occurred.)

Example 2

An electrophotographic photosensitive member was produced in the same manner as that in Example 1, and its surface was processed in the same way as that in Example 1 except that, in the mold used in Example 1, the height shown by F in FIG. 12 which was 3.0 μm was changed to 2.4 μm. The surface profile was measured in the same way as that in Example 1 to ascertain that columnar depressed portions stood formed. The results of measurement are shown in Table 1. The depressed portions were formed at intervals of 1.0 μm. Their opening area percentage was calculated to find that it was 20%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Example 3

An electrophotographic photosensitive member was produced in the same manner as that in Example 1, and its surface was processed in the same way as that in Example 1 except that, in the mold used in Example 1, the major-axis diameter shown by D in FIG. 12 which was 1.0 μm was changed to 0.5 μm, the interval shown by E which was 1.0 μm was changed to 0.5 μm and the height shown by F which was 3.0 μm was changed to 2.0 μm. The surface profile was measured in the same way as that in Example 1 to ascertain that columnar depressed portions stood formed. The results of measurement are shown in Table 1. The depressed portions were formed at intervals of 0.5 μm. Their opening area percentage was calculated to find that it was 20%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Example 4

An electrophotographic photosensitive member was produced in the same manner as that in Example 1, and its surface was processed in the same way as that in Example 1 except that, in the mold used in Example 1, the major-axis diameter shown by D in FIG. 12 which was 1.0 μm was changed to 0.2 μm, the interval shown by E which was 1.0 μm was changed to 0.2 μm and the height shown by F which was 3.0 μm was changed to 2.0 μm. The surface profile was measured in the same way as that in Example 1 to ascertain that columnar depressed portions stood formed. The results of measurement are shown in Table 1. The depressed portions were formed at intervals of 0.2 μm. Their opening area percentage was calculated to find that it was 20%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Example 5

An electrophotographic photosensitive member was produced in the same manner as that in Example 1, and its surface was processed in the same way as that in Example 1 except that, in the mold used in Example 1, the major-axis diameter shown by D in FIG. 12 which was 1.0 μm was changed to 0.5 μm, the interval shown by E which was 1.0 μm was changed to 0.2 μm and the height shown by F which was 3.0 μm was changed to 2.0 μm. The surface profile was measured in the same way as that in Example 1 to ascertain that columnar depressed portions stood formed. The results of measurement are shown in Table 1. The depressed portions were formed at intervals of 0.2 μm. Their opening area percentage was calculated to find that it was 40%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Example 6

An electrophotographic photosensitive member was produced in the same manner as that in Example 1, and its surface was processed in the same way as that in Example 1 except that, in the mold used in Example 1, the major-axis diameter shown by D in FIG. 12 which was 1.0 μm was changed to 0.5 μm, the interval shown by E which was 1.0 μm was changed to 0.1 μm and the height shown by F which was 3.0 μm was changed to 2.0 μm. The surface profile was measured in the same way as that in Example 1 to ascertain that columnar depressed portions stood formed. The results of measurement are shown in Table 1. The depressed portions were formed at intervals of 0.1 μm. Their opening area percentage was calculated to find that it was 55%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Example 7

Figure 14:
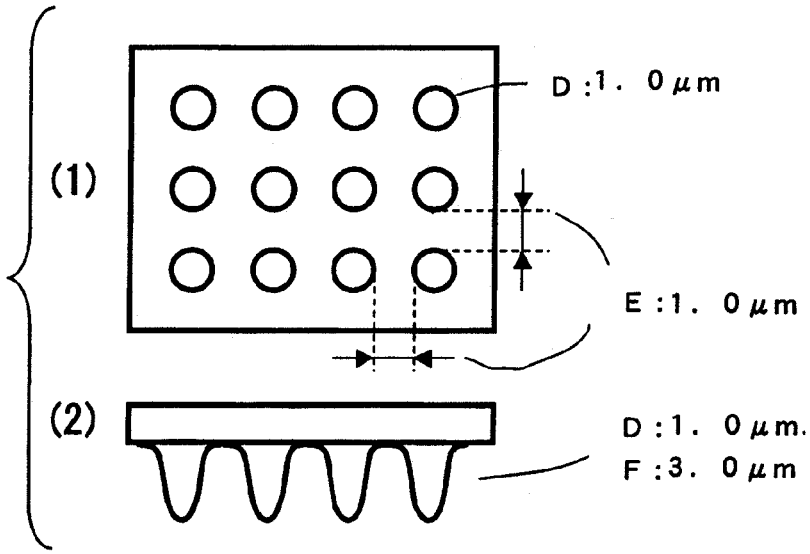
FIG. 14 is a view showing a surface profile of a mold (partial enlarged view) used in Example 7. A view (1) in FIG. 14 shows the surface profile of the mold as viewed from its top, and a view (2) shows the surface profile of the mold as viewed from its side.
Figure 15:
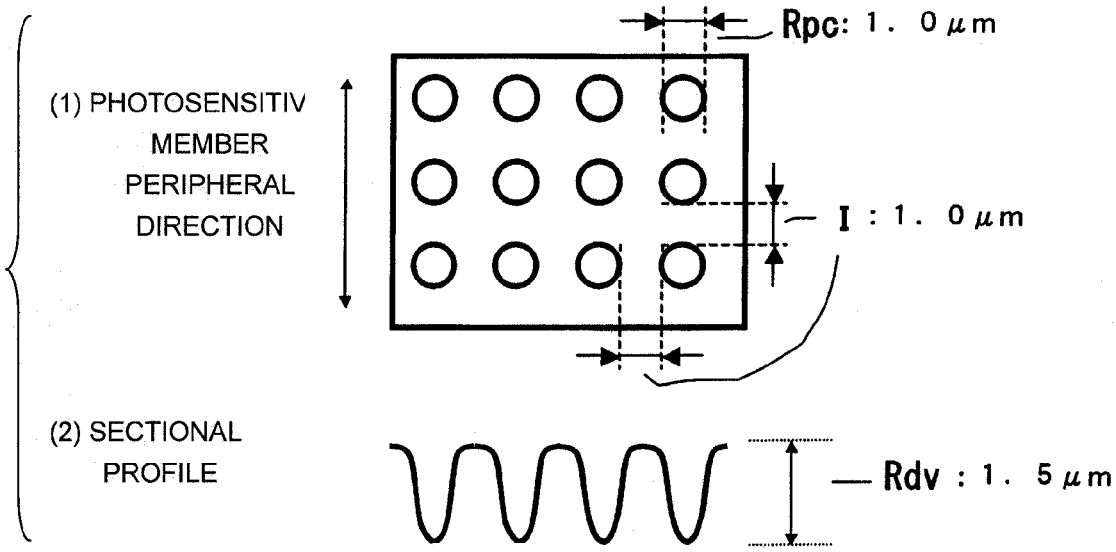
FIG. 15 is a view showing an arrangement pattern of depressed portions (partial enlarged view) of the photosensitive member outermost surface obtained according to Example 7. A view (1) in FIG. 15 shows how the depressed portions formed on the surface of the photosensitive member are arranged, and a view (2) shows a sectional profile of the depressed portions.

An electrophotographic photosensitive member was produced in the same manner as that in Example 1, and its surface was processed in the same way as that in Example 1 except that the mold used in Example 1 was changed for a mold having a hill-shaped surface profile as shown in FIG. 14. In FIG. 14, a view (1) shows the surface profile of the mold as viewed from its top, and a view (2) shows the surface profile of the mold as viewed from its side. The mold shown in FIG. 14 has the hill-shaped surface profile. Its hills each have a major-axis diameter D of 1.0 μm, a height F of 3.0 μm and a hill-to-hill interval E of 1.0 μm. This surface profile was measured in the same way as that in Example 1 to ascertain that the hill-corresponding depressed portions shown in FIG. 15 stood formed. In FIG. 15, a view (1) shows how the depressed portions formed on the surface of the photosensitive member are arranged, and a view (2) shows a sectional profile of the depressed portions. The results of measurement are shown in Table 1. The depressed portions were formed at intervals of 1.0 μm. Their opening area percentage was calculated to find that it was 20%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Example 8

Figure 16:
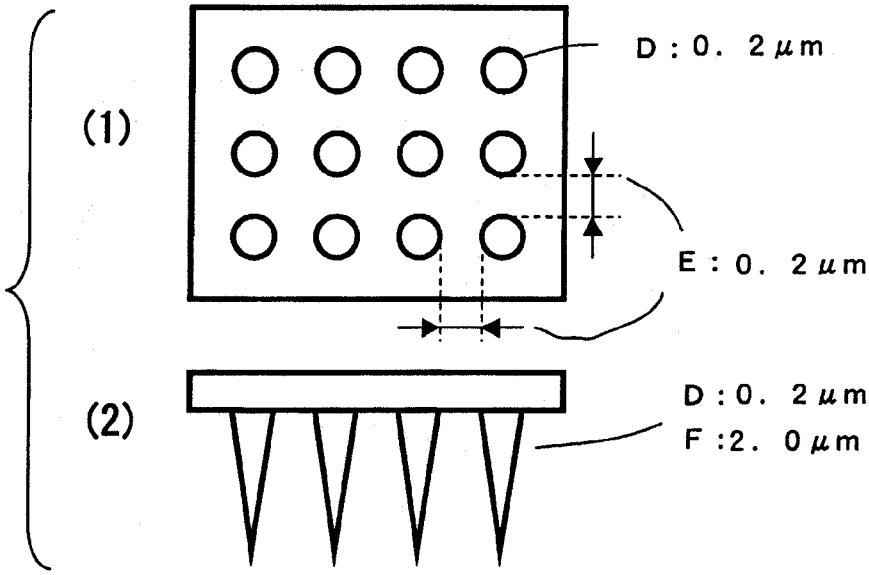
FIG. 16 is a view showing a surface profile of a mold (partial enlarged view) used in Example 8. A view (1) in FIG. 16 shows the surface profile of the mold as viewed from its top, and a view (2) shows the surface profile of the mold as viewed from its side.
Figure 17:
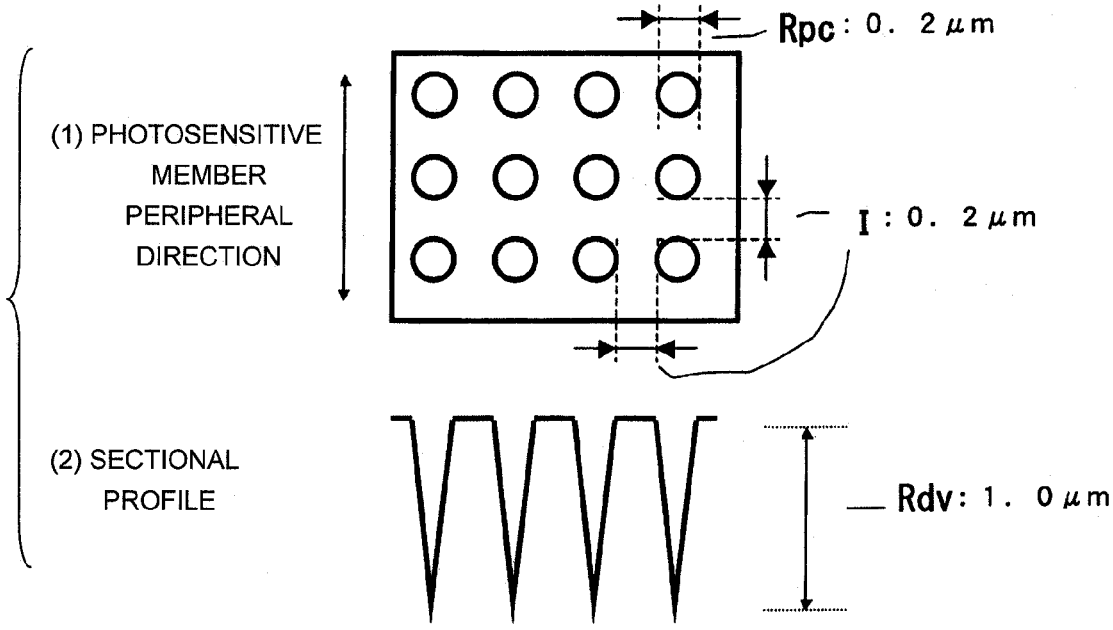
FIG. 17 is a view showing an arrangement pattern of depressed portions (partial enlarged view) of the photosensitive member outermost surface obtained according to Example 8. A view (1) in FIG. 17 shows how the depressed portions formed on the surface of the photosensitive member are arranged, and a view (2) shows a sectional profile of the depressed portions.

An electrophotographic photosensitive member was produced in the same manner as that in Example 1, and its surface was processed in the same way as that in Example 1 except that the mold used in Example 1 was changed for a mold having a cone-shaped surface profile as shown in FIG. 16. In FIG. 16, a view (1) shows the surface profile of the mold as viewed from its top, and a view (2) shows the surface profile of the mold as viewed from its side. The mold shown in FIG. 16 has the cone-shaped surface profile. Its cones each have a major-axis diameter D of 0.2 μm, a height F of 2.0 μm and a cone-to-cone interval E of 0.2 μm. This surface profile was measured in the same way as that in Example 1 to ascertain that the conical depressed portions shown in FIG. 17 stood formed. In FIG. 17, a view (1) shows how the depressed portions formed on the surface of the photosensitive member are arranged, and a view (2) shows a sectional profile of the depressed portions. The results of measurement are shown in Table 1. The depressed portions were formed at intervals of 0.2 μm. Their opening area percentage was calculated to find that it was 20%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Example 9

In Example 1, the second charge transport layer coating solution was prepared without addition of the fluorine atom-containing resin (trade name: GF-300, available from Toagosei Chemical Industry Co., Ltd.) and the tetrafluoroethylene resin powder (trade name: LUBRON L-2, available from Daikin Industries, Ltd.). An electrophotographic photosensitive member was produced in the same manner as that in Example 1 except the above, and its surface was processed in the same way as that in Example 7, using the mold used in Example 7. The surface profile was measured in the same way as that in Example 1 to ascertain that hill-corresponding depressed portions stood formed. The results of measurement are shown in Table 1. The depressed portions were formed at intervals of 1.0 μm. Their opening area percentage was calculated to find that it was 20%. The modulus of elastic deformation and the universal hardness were measured in the same way as those in Example 1. As the result, the value of modulus of elastic deformation was 62% and the value of universal hardness was 200 N/mm$^2$. Performance of the electrophotographic photosensitive member was also evaluated in the same way as that in Example 1. The results are shown in Table 1.

Example 10

In Example 1, the second charge transport layer coating solution was prepared using the fluorine atom-containing resin (trade name: GF-300, available from Toagosei Chemical Industry Co., Ltd.) and the tetrafluoroethylene resin powder (trade name: LUBRON L-2, available from Daikin Industries, Ltd.) in amounts of 2.0 parts and 40 parts, respectively. An electrophotographic photosensitive member was produced in the same manner as that in Example 1 except the above, and its surface was processed in the same way as that in Example 7, using the mold used in Example 7. The surface profile was measured in the same way as that in Example 1 to ascertain that hill-corresponding depressed portions stood formed. The results of measurement are shown in Table 1. The depressed portions were formed at intervals of 1.0 μm. Their opening area percentage was calculated to find that it was 20%. The modulus of elastic deformation and the universal hardness were measured in the same way as those in Example 1. As the result, the value of modulus of elastic deformation was 50% and the value of universal hardness was 175 N/mm$^2$. Performance of the electrophotographic photosensitive member was also evaluated in the same way as that in Example 1. The results are shown in Table 1.

Example 11

In Example 1, the second charge transport layer coating solution was prepared using the fluorine atom-containing resin (trade name: GF-300, available from Toagosei Chemical Industry Co., Ltd.) and the tetrafluoroethylene resin powder (trade name: LUBRON L-2, available from Daikin Industries, Ltd.) in amounts of 3.0 parts and 60 parts, respectively. An electrophotographic photosensitive member was produced in the same manner as that in Example 1 except the above, and its surface was processed in the same way as that in Example 7, using the mold used in Example 7. The surface profile was measured in the same way as that in Example 1 to ascertain that hill-corresponding depressed portions stood formed. The results of measurement are shown in Table 1. The depressed portions were formed at intervals of 1.0 μm. Their opening area percentage was calculated to find that it was 20%. The modulus of elastic deformation and the universal hardness were measured in the same way as those in Example 1. As the result, the value of modulus of elastic deformation was 45% and the value of universal hardness was 165 N/mm$^2$. Performance of the electrophotographic photosensitive member was also evaluated in the same way as that in Example 1. The results are shown in Table 1.

Example 12

The procedure of Example 1 was repeated to form on the support the conductive layer, the intermediate layer and the charge generation layer. Next, the following components were dissolved in a mixed solvent of 600 parts of chlorobenzene and 200 parts of methylal to prepare a charge transport layer coating solution. This charge transport layer coating solution was applied on the charge generation layer by dip coating, followed by heat drying for 30 minutes in an oven heated to 110° C., to form a charge transport layer with an average layer thickness of 15 μm at the position of 170 mm from the support upper end.

| | |
|---|---|
| Charge transporting material (hole transporting material) represented by the above formula (2) | 70 parts |
| Copolymer type polyarylate resin represented by the following structural formula (4) | 100 parts |

(4)

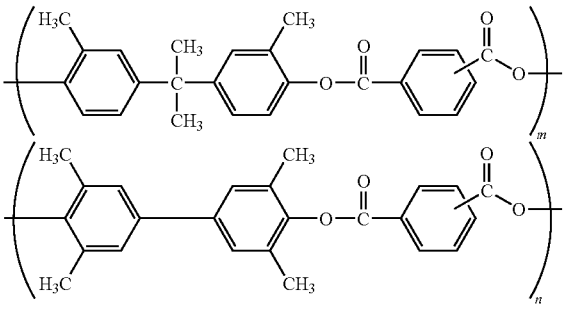

(In the formula, m and n each represent a ratio (copolymerization ratio) of repeating units in this resin. In this resin, m:n is 7:3. The form of copolymerization is a random copolymer.)

In the above polyarylate resin, the molar ratio of terephthalic acid structure to isophthalic acid structure (terephthalic acid structure:isophthalic acid structure) is 50:50. The resin has a weight average molecular weight (Mw) of 130,000.

In the present invention, the weight-average molecular weight of the resin is measured in the following way by a conventional method.

That is, a measuring target resin is put in tetrahydrofuran, and was left to stand for several hours. Thereafter, with shaking, the measuring target resin was well mixed with the tetrahydrofuran (mixed until coalescent matter of the measuring target resin disappeared), which was further left to stand for 12 hours or more.

Thereafter, what was passed through a sample-treating filter MAISHORIDISK H-25-5, available from Tosoh Corporation, was used as a sample for GPC (gel permeation chromatography).

Next, columns were stabilized in a 40EC heat chamber. To the columns kept at this temperature, tetrahydrofuran was flowed at a flow rate of 1 ml per minute, and 10 μl of the sample for GPC was injected thereinto to make measurement. As the columns, TSKgel SuperHM-M, available from Tosoh Corporation, was used.

In measuring the weight average molecular weight of the measuring target resin, the molecular weight distribution the measuring target resin has was calculated from the relationship between the logarithmic value of a calibration curve prepared using several kinds of monodisperse polystyrene standard samples and the count number. As the standard polystyrene samples for preparing the calibration curve, used were 10 monodisperse polystyrene samples with molecular weights of 3,500, 12,000, 40,000, 75,000, 98,000, 120,000, 240,000, 500,000, 800,000 and 1,800,000 available from Aldrich Chemical Co., Inc. An RI (refractive index) detector was used as a detector.

The electrophotographic photosensitive member produced in the manner described above was subjected to surface processing in the same way as that in Example 1 except that, in the mold used in Example 1, the height shown by F in FIG. 12 which was 3.0 μm was changed to 6.0 μm. The surface profile was measured in the same way as that in Example 1 to ascertain that columnar depressed portions stood formed. The results of measurement are shown in Table 1. The depressed portions were formed at intervals of 1.0 μm. Their opening area percentage was calculated to find that it was 20%. The modulus of elastic deformation and the universal hardness were measured in the same way as those in Example 1. As the result, the value of modulus of elastic deformation was 42% and the value of universal hardness was 230 N/mm$^2$. Performance of the electrophotographic photosensitive member was also evaluated in the same way as that in Example 1. The results are shown in Table 1.

Example 13

An electrophotographic photosensitive member was produced in the same manner as that in Example 12, and its surface was processed in the same way as that in Example 1 except that, in the mold used in Example 1, the major-axis diameter shown by D in FIG. 12 which was 1.0 μm was changed to 2.5 μm, the interval shown by E which was 1.0 μm was changed to 2.0 μm and the height shown by F which was 3.0 μm was changed to 7.0 μm. The surface profile was measured in the same way as that in Example 1 to ascertain that columnar depressed portions stood formed. The results of measurement are shown in Table 1. The depressed portions were formed at intervals of 2.0 μm. Their opening area percentage was calculated to find that it was 24%. Performance of the electrophotographic photosensitive member was also evaluated in the same way as that in Example 1. The results are shown in Table 1.

Example 14

An electrophotographic photosensitive member was produced in the same manner as that in Example 12, and its surface was processed in the same way as that in Example 1 except that, in the mold used in Example 1, the major-axis diameter shown by D in FIG. 12 which was 1.0 μm was changed to 4.5 μm, the interval shown by E which was 1.0 μm was changed to 5.0 μm and the height shown by F which was 3.0 μm was changed to 10.0 μm. The surface profile was measured in the same way as that in Example 1 to ascertain that columnar depressed portions stood formed. The results of measurement are shown in Table 1. The depressed portions were formed at intervals of 5.0 μm. Their opening area percentage was calculated to find that it was 18%. Performance of the electrophotographic photosensitive member was also evaluated in the same way as that in Example 1. The results are shown in Table 1.

Example 15

An electrophotographic photosensitive member was produced in the same manner as that in Example 12, and its surface was processed in the same way as that in Example 1 except that, in the mold used in Example 1, the major-axis diameter shown by D in FIG. 12 which was 1.0 μm was changed to 2.0 μm and the height shown by F which was 3.0 μm was changed to 5.0 μm. The surface profile was measured in the same way as that in Example 1 to ascertain that columnar depressed portions stood formed. The results of measurement are shown in Table 1. The depressed portions were formed at intervals of 1.0 μm. Their opening area percentage was calculated to find that it was 35%. Performance of the electrophotographic photosensitive member was also evaluated in the same way as that in Example 1. The results are shown in Table 1.

Example 16

An electrophotographic photosensitive member was produced in the same manner as that in Example 12, and its surface was processed in the same way as that in Example 1 except that, in the mold used in Example 1, the major-axis diameter shown by D in FIG. 12 which was 1.0 μm was changed to 3.0 μm, the interval shown by E which was 1.0 μm was changed to 2.0 μm and the height shown by F which was 3.0 μm was changed to 9.0 μm. The surface profile was measured in the same way as that in Example 1 to ascertain that columnar depressed portions stood formed. The results of measurement are shown in Table 1. The depressed portions were formed at intervals of 2.0 μm. Their opening area percentage was calculated to find that it was 28%. Performance of the electrophotographic photosensitive member was also evaluated in the same way as that in Example 1. The results are shown in Table 1.

Example 17

The procedure of Example 1 was repeated to form on the support the conductive layer, the intermediate layer and the charge generation layer.

Next, the following components were dissolved in a mixed solvent of 600 parts of chlorobenzene and 200 parts of methylal to prepare a charge transport layer coating solution. This charge transport layer coating solution was applied on the charge generation layer by dip coating, followed by heat drying for 30 minutes in an oven heated to 110° C., to form a charge transport layer with an average layer thickness of 15 μm at the position of 170 mm from the support upper end.

| | |
|---|---|
| Charge transporting material (hole transporting material) represented by the above formula (2) | 70 parts |
| Copolymer type polyarylate resin represented by the following structural formula (5) | 100 parts |

(5)

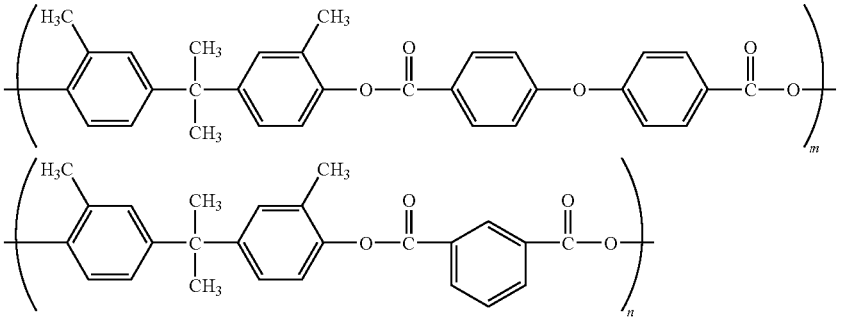

(In the formula, m and n each represent a ratio (copolymerization ratio) of repeating units in this resin. In this resin, m:n is 7:3. The form of copolymerization is a random copolymer.)

The above polyarylate resin has a weight average molecular weight Mw of 120,000.

The electrophotographic photosensitive member produced in the manner described above was subjected to surface processing in the same way as that in Example 1 except that, in the mold used in Example 1, the major-axis diameter shown by D in FIG. 12 which was 1.0 μm was changed to 5.5 μm, the interval shown by E which was 1.0 μm was changed to 5.0 μm and the height shown by F which was 3.0 μm was changed to 12.0 μm. The surface profile was measured in the same way as that in Example 1 to ascertain that columnar depressed portions stood formed. The results of measurement are shown in Table 1. The depressed portions were formed at intervals of 5.0 μm. Their opening area percentage was calculated to find that it was 22%. The modulus of elastic deformation and the universal hardness were measured in the same way as those in Example 1. As the result, the value of modulus of elastic deformation was 43% and the value of universal hardness was 240 N/mm$^2$. Performance of the electrophotographic photosensitive member was also evaluated in the same way as that in Example 1. The results are shown in Table 1.

Example 18

An electrophotographic photosensitive member was produced in the same manner as that in Example 17, and its surface was processed in the same way as that in Example 1 except that, in the mold used in Example 1, the major-axis diameter shown by D in FIG. 12 which was 1.0 μm was changed to 3.0 μm, the interval shown by E which was 1.0 μm was changed to 2.0 μm and the height shown by F which was 3.0 μm was changed to 7.0 μm. The surface profile was measured in the same way as that in Example 1 to ascertain that columnar depressed portions stood formed. The results of measurement are shown in Table 1. The depressed portions were formed at intervals of 2.0 μm. Their opening area percentage was calculated to find that it was 28%. Performance of the electrophotographic photosensitive member was also evaluated in the same way as that in Example 1. The results are shown in Table 1.

Example 19

An electrophotographic photosensitive member was produced in the same manner as that in Example 17, and its surface was processed in the same way as that in Example 1 except that, in the mold used in Example 1, the major-axis diameter shown by D in FIG. 12 which was 1.0 μm was changed to 2.0 μm and the height shown by F which was 3.0 μm was changed to 6.0 μm. The surface profile was measured in the same way as that in Example 1 to ascertain that columnar depressed portions stood formed. The results of measurement are shown in Table 1. The depressed portions were formed at intervals of 1.0 μm. Their opening area percentage was calculated to find that it was 34%. Performance of the electrophotographic photosensitive member was also evaluated in the same way as that in Example 1. The results are shown in Table 1.

Example 20

An electrophotographic photosensitive member was produced in the same manner as that in Example 17, and its surface was processed in the same way as that in Example 1 except that, in the mold used in Example 1, the interval shown by E in FIG. 12 which was 1.0 μm was changed to 2.0 μm and the height shown by F which was 3.0 μm was changed to 4.0 μm. The surface profile was measured in the same way as that in Example 1 to ascertain that columnar depressed portions stood formed. The results of measurement are shown in Table 1. The depressed portions were formed at intervals of 2.0 μm. Their opening area percentage was calculated to find that it was 20%. Performance of the electrophotographic photosensitive member was also evaluated in the same way as that in Example 1. The results are shown in Table 1.

Comparative Example 1

An electrophotographic photosensitive member was produced in the same manner as that in Example 1, and its surface was processed in the same way as that in Example 1 except that, in the mold used in Example 1, the height shown by F in FIG. 12 which was 3.0 μm was changed to 1.4 μm. The surface profile was measured in the same way as that in Example 1 to ascertain that columnar depressed portions stood formed. The total number of depressed portions in 100 μm square of the electrophotographic photosensitive member surface was calculated to find that 2,500 depressed portions stood formed. However, any depressed portion having the ratio of depth to major-axis diameter, Rdv/Rpc, of from more than 1.0 to 7.0 or less was not seen to have been formed. The average major-axis diameter (Rpc-A) and average depth (Rdv-A) of the depressed portions in 100 μm square are shown in Table 1. The depressed portions were formed at intervals of 1.0 μm. Their opening area percentage was calculated to find that it was 20%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Comparative Example 2

An electrophotographic photosensitive member was produced in the same manner as that in Example 1, and its surface was processed in the same way as that in Example 1 except that, in the mold used in Example 1, the major-axis diameter shown by D in FIG. 12 which was 1.0 μm was changed to 5.0 μm and the height shown by F which was 3.0 μm was changed to 1.0 μm. The surface profile was measured in the same way as that in Example 1 to ascertain that columnar depressed portions stood formed. The total number of depressed portions in 100 μm square of the electrophotographic photosensitive member surface was calculated to find that 278 depressed portions stood formed. However, any depressed portion having the ratio of depth to major-axis diameter, Rdv/Rpc, of from more than 1.0 to 7.0 or less was not seen to have been formed. The average major-axis diameter (Rpc-A) and average depth (Rdv-A) of the depressed portions in 100 μm square are shown in Table 1. The depressed portions were formed at intervals of 1.0 μm. Their opening area percentage was calculated to find that it was 55%. The modulus of elastic deformation and the universal hardness were measured in the same way as those in Example 1. As the result, the value of modulus of elastic deformation was 55% and the value of universal hardness was 180 N/mm$^2$. Performance of the electrophotographic photosensitive member was also evaluated in the same way as that in Example 1. The results are shown in Table 1.

Comparative Example 3

An electrophotographic photosensitive member was produced in the same manner as that in Example 12, and its surface was processed in the same way as that in Example 1 except that, in the mold used in Example 1, the height shown by F in FIG. 12 which was 3.0 μm was changed to 1.6 μm. The surface profile was measured in the same way as that in Example 1 to ascertain that columnar depressed portions stood formed. The total number of depressed portions in 100 μm square of the electrophotographic photosensitive member surface was calculated to find that 2,500 depressed portions stood formed. However, any depressed portion having the ratio of depth to major-axis diameter, Rdv/Rpc, of from more than 1.0 to 7.0 or less was not seen to have been formed. The average major-axis diameter (Rpc-A) and average depth (Rdv-A) of the depressed portions in 100 μm square are shown in Table 1. The depressed portions were formed at intervals of 1.0 μm. Their opening area percentage was calculated to find that it was 20%. The modulus of elastic deformation and the universal hardness were measured in the same way as those in Example 1. As the result, the value of modulus of elastic deformation was 42% and the value of universal hardness was 230 N/mm$^2$. Performance of the electrophotographic photosensitive member was also evaluated in the same way as that in Example 1. The results are shown in Table 1.

Comparative Example 4

An electrophotographic photosensitive member was produced in the same manner as that in Example 1, and its surface was not processed. Whether or not any blade chattering occurred at the time of the paper feed running test of the electrophotographic photosensitive member was evaluated in the same way as that in Example 1. The results are shown in Table 1.

Comparative Example 5

An electrophotographic photosensitive member was produced in the same manner as that in Example 1, and the surface of the electrophotographic photosensitive member was roughened by sand blasting in which glass beads of 35 μm in average particle diameter were blasted against the photosensitive member surface. The surface profile was measured in the same way as that in Example 1 to ascertain that partially spherical depressed portions stood formed. The total number of depressed portions in 100 μm square of the electrophotographic photosensitive member surface was calculated to find that 6 (six) depressed portions stood formed. However, any depressed portion having the ratio of depth to major-axis diameter, Rdv/Rpc, of from more than 1.0 to 7.0 or less was not seen to have been formed. The average major-axis diameter (Rpc-A) and average depth (Rdv-A) of the depressed portions in 100 μm square are shown in Table 1. Note, here, that the number of depressed portions embraced completely in the 100 μm square was calculated and used as the number of depressed portions each having the ratio of depth to major-axis diameter, Rdv/Rpc, of from more than 1.0 to 7.0 or less. Performance of the electrophotographic photosensitive member was also evaluated in the same way as that in Example 1. The results are shown in Table 1.

Comparative Example 6

An electrophotographic photosensitive member was produced in the same manner as that in Example 1, and the surface of the electrophotographic photosensitive member was roughened by sand blasting in which glass beads of 70 μm in average particle diameter were blasted against the photosensitive member surface. The surface profile was measured in the same way as that in Example 1 to ascertain that partially spherical depressed portions stood formed. The total number of depressed portions in 100 μm square of the electrophotographic photosensitive member surface was calculated to find that 1 (one) depressed portion stood formed. However, any depressed portion having the ratio of depth to major-axis diameter, Rdv/Rpc, of from more than 1.0 to 7.0 or less was not seen to have been formed. The average major-axis diameter (Rpc-A) and average depth (Rdv-A) of the depressed portions in 100 μm square are shown in Table 1. Note, here, that the number of depressed portion(s) embraced completely in the 100 μm square was calculated and used as the number of depressed portions each having the ratio of depth to major-axis diameter, Rdv/Rpc, of from more than 1.0 to 7.0 or less. Performance of the electrophotographic photosensitive member was also evaluated in the same way as that in Example 1. The results are shown in Table 1.

TABLE 1

| | Number (depressed Portions) | Rpc-A (μm) | Rdv-A (μm) | Rdv-A/Rpc-A | Torque rate | Blade chattering in 50,000-sheet running |
|---|---|---|---|---|---|---|
| Example: | | | | | | |
| 1 | 2,500 | 1.0 | 1.5 | 1.5 | 0.35 | Good. |
| 2 | 2,500 | 1.0 | 1.2 | 1.2 | 0.45 | X: 45,000 *1 |
| 3 | 10,000 | 0.5 | 1.0 | 2.0 | 0.30 | Good. |
| 4 | 62,500 | 0.2 | 1.0 | 5.0 | 0.28 | Good. |
| 5 | 20,399 | 0.5 | 1.0 | 2.0 | 0.30 | Good. |
| 6 | 27,777 | 0.5 | 1.0 | 2.0 | 0.30 | Good. |
| 7 | 2,500 | 1.0 | 1.5 | 1.5 | 0.35 | Good. |
| 8 | 62,500 | 0.2 | 1.0 | 5.0 | 0.30 | Good. |
| 9 | 2,500 | 1.0 | 1.5 | 1.5 | 0.33 | Good. |
| 10 | 2,500 | 1.0 | 1.5 | 1.5 | 0.35 | Good. |
| 11 | 2,500 | 1.0 | 1.5 | 1.5 | 0.33 | Good. |
| 12 | 2,500 | 1.0 | 3.0 | 3.0 | 0.30 | Good. |
| 13 | 480 | 2.5 | 3.5 | 1.4 | 0.30 | Good. |
| 14 | 100 | 4.5 | 5.0 | 1.1 | 0.33 | Good. |
| 15 | 1,089 | 2.0 | 2.5 | 1.3 | 0.45 | X: 45,000 *1 |
| 16 | 400 | 3.0 | 4.5 | 1.5 | 0.35 | Good. |
| 17 | 81 | 5.5 | 6.0 | 1.1 | 0.35 | Good. |
| 18 | 400 | 3.0 | 3.5 | 1.2 | 0.43 | Good. |
| 19 | 1,089 | 2.0 | 3.0 | 1.5 | 0.38 | Good. |
| 20 | 2,500 | 1.0 | 2.0 | 2.0 | 0.30 | Good. |
| Comparative Example: | | | | | | |
| 1 | 0 | 1.0 | 0.7 | 0.7 | 0.65 | X: 40,000 *2 |
| 2 | 0 | 5.0 | 0.5 | 0.1 | 0.75 | X: 25,000 *2 |
| 3 | 0 | 1.0 | 0.8 | 0.8 | 0.70 | X: 10,000 *2 |
| 4 | 0 | — | — | — | — | Initial *3 |
| 5 | 0 | 35 | 0.5 | 0.01 | 0.78 | X: 35,000 *2 |
| 6 | 0 | 70 | 0.3 | 0.004 | 0.85 | X: 1,000 *2 |

*1 Occurred very slightly after the X-th sheet.
*2 Occurred after the X-th sheet.
*3 Occurred from the beginning.

The above results demonstrate that, in comparison between Examples 1 to 20 of the present invention and Comparative Examples 1 to 6, the electrophotographic photosensitive member having on its surface the depressed portions each having the ratio of depth to major-axis diameter, Rdv/Rpc, of from more than 1.0 to 7.0 or less enables improvement in cleaning performance, in particular, much better prevention of the blade chattering at the time of repeated service. The results of torque rate of the electrophotographic photosensitive member having the depressed portions of the present invention show that the electrophotographic photosensitive member having the depressed portions of the present invention has achieved a low frictional resistance between the electrophotographic photosensitive member and the cleaning blade. In the evaluation made in the present invention, 50,000-sheet running performance is evaluated on electrophotographic photosensitive members having photosensitive layers which are each formed on the support of 30 mm in diameter. Nevertheless, the effect of lowering the blade chattering is seen even under such evaluation conditions. Photosensitive members show a tendency to cause no blade chattering at the initial stage of their service, as long as any depressed portions are formed on the photosensitive member surface. In their repeated service, however, results are seen how long the effect of lowering the blade chattering is maintained differs depending on the shape of depressed portions on the surfaces. This is considered to show that the effect of lowering the amount of a load produced between the electrophotographic photosensitive member and the cleaning blade is maintained in virtue of the feature that the surface has the specific depressed portions, to obtain the result that the blade chattering is much better prevented.

Example 21

Figure 18:
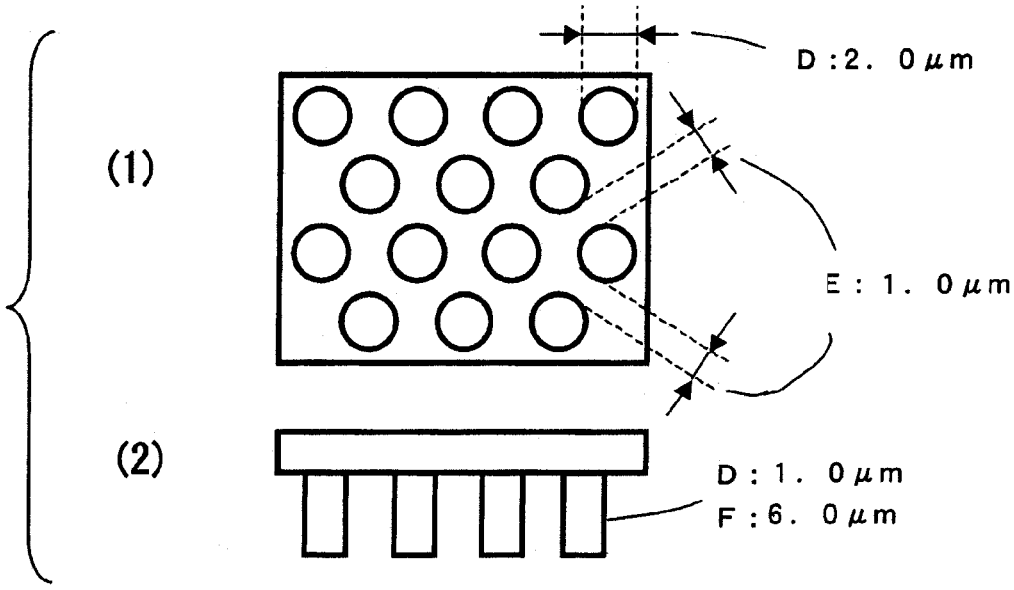
FIG. 18 is a view showing a surface profile of a mold used in Example 21. A view (1) in FIG. 18 shows the surface profile of the mold as viewed from its top, and a view (2) shows the surface profile of the mold as viewed from its side.

An electrophotographic photosensitive member was produced in the same manner as that in Example 1. The electrophotographic photosensitive member thus produced was subjected to surface processing by setting it in the surface processing unit shown in FIG. 7, using a mold for surface profile transfer shown in FIG. 18, made of nickel. In FIG. 18, a view (1) shows the surface profile of the mold as viewed from its top, and a view (2) shows the surface profile of the mold as viewed from its side. The mold shown in FIG. 18 has a column-shaped surface profile. Its columns each have a major-axis diameter D of 2.0 μm, a height F of 6.0 μm and a column-to-column interval E of 1.0 μm. The temperature of the electrophotographic photosensitive member and temperature of the mold at the time of the surface processing were controlled at 110° C., and the electrophotographic photosensitive member was rotated in its peripheral direction with pressuring at a pressure of 5 MPa to perform surface profile transfer.

Figure 19:
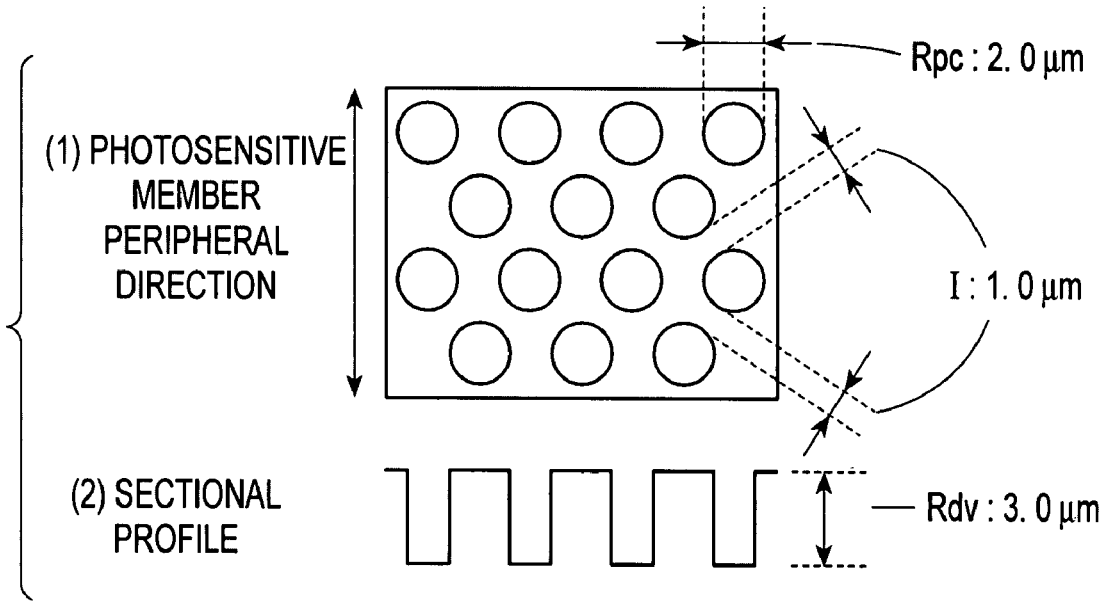
FIG. 19 is a view showing an arrangement pattern of depressed portions (partial enlarged view) of the photosensitive member outermost surface obtained according to Example 21. A view (1) in FIG. 19 shows how the depressed portions formed on the surface of the photosensitive member are arranged, and a view (2) shows a sectional profile of the depressed portions.

The surface profile was measured in the same way as that in Example 1 to ascertain that depressed portions as shown in FIG. 19 stood formed on the surface. In FIG. 19, which shows how the depressed portions are arranged, a view (1) shows the photosensitive member surface as viewed from its top, and a view (2) shows a sectional profile of the depressed portions. The number, average major-axis diameter (Rpc-A) and average depth (Rdv-A) of depressed portions in 100 μm square which have the ratio of depth to major-axis diameter, Rdv/Rpc, of from more than 1.0 to 7.0 or less are shown in Table 2. The depressed portions were formed at intervals of 1.0 μm. Their opening area percentage was calculated to find that it was 46%.

The electrophotographic photosensitive member produced in the manner described above was evaluated on its performance in the same way as that in Example 1. The results are shown in Table 2. (In Table 2, "Number" shows the number of depressed portions in 100 μm square which have the ratio of depth to major-axis diameter, Rdv/Rpc, of from more than 1.0 to 7.0 or less. "Rpc-A" stands for the average major-axis diameter of depressed portions present in 100 μm square. "Rdv-A" stands for the average depth of depressed portions present in 100 μm square. "Rdv-A/Rpc-A" stands for the ratio of average depth to average major-axis diameter of depressed portions present in 100 μm square. "Torque rate" shows the relative torque rate found by the method described in Example 1. "Blade chattering in 50,000-running" shows whether or not the blade chattering occurred in the paper feed running test according to the method described in Example 1, or the number of sheet at which the blade chattering occurred.)

Example 22

An electrophotographic photosensitive member was produced in the same manner as that in Example 21, and its surface was processed in the same way as that in Example 1 except that, in the mold used in Example 21, the major-axis diameter shown by D in FIG. 12 which was 2.0 μm was changed to 1.5 μm, the interval shown by E which was 1.0 μm was changed to 0.8 μm and the height shown by F which was 6.0 μm was changed to 7.0 μm. The surface profile was measured in the same way as that in Example 1 to ascertain that columnar depressed portions stood formed. The results of measurement are shown in Table 2. The depressed portions were formed at intervals of 0.8 μm. Their opening area percentage was calculated to find that it was 39%. Performance of the electrophotographic photosensitive member was also evaluated in the same way as that in Example 1. The results are shown in Table 2.

Example 23

An electrophotographic photosensitive member was produced in the same manner as that in Example 21, and its surface was processed in the same way as that in Example 1 except that, in the mold used in Example 21, the major-axis diameter shown by D in FIG. 12 which was 2.0 μm was changed to 4.0 μm, the interval shown by E which was 1.0 μm was changed to 2.0 μm and the height shown by F which was 6.0 μm was changed to 9.0 μm. The surface profile was measured in the same way as that in Example 1 to ascertain that columnar depressed portions stood formed. The results of measurement are shown in Table 2. The depressed portions were formed at intervals of 2.0 μm. Their opening area percentage was calculated to find that it was 63%. Performance of the electrophotographic photosensitive member was also evaluated in the same way as that in Example 1. The results are shown in Table 2.

Example 24

Figure 20:
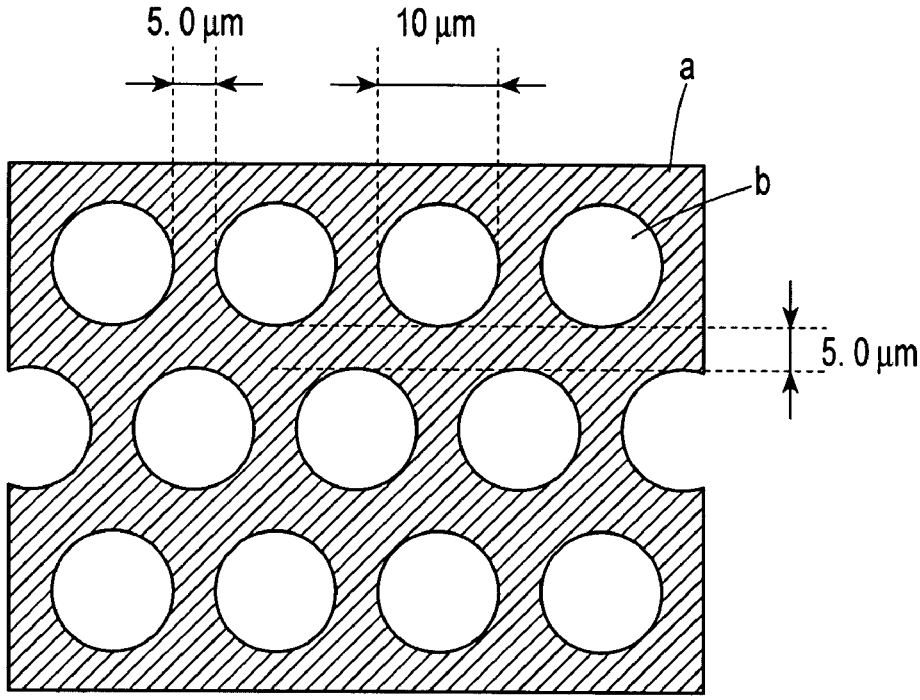
FIG. 20 is a view showing an arrangement pattern of a mask (partial enlarged view) used in Example 24.

An electrophotographic photosensitive member was produced in the same manner as that in Example 21. On the surface of the electrophotographic photosensitive member obtained, depressed portions were formed by using a depressed portion forming method making use of a KrF excimer laser (wavelength λ: 248 nm) like that shown in FIG. 4. Here, a mask made of quartz glass was used which had a pattern in which circular laser light transmitting areas of 10 μm in diameter as shown in FIG. 20 were arranged at intervals of 5.0 μm as shown in the drawing. Irradiation energy was set at 0.9 J/cm$^3$. Further, irradiation was made in an area of 2 mm square per irradiation made once, and the surface was irradiated with the laser light three times per irradiation portion of 2 mm square. The depressed portions were likewise formed by a method in which, as shown in FIG. 4, the electrophotographic photosensitive member was rotated and the irradiation position was shifted in its axial direction, to form the depressed portions on the photosensitive member surface.

Figure 21:
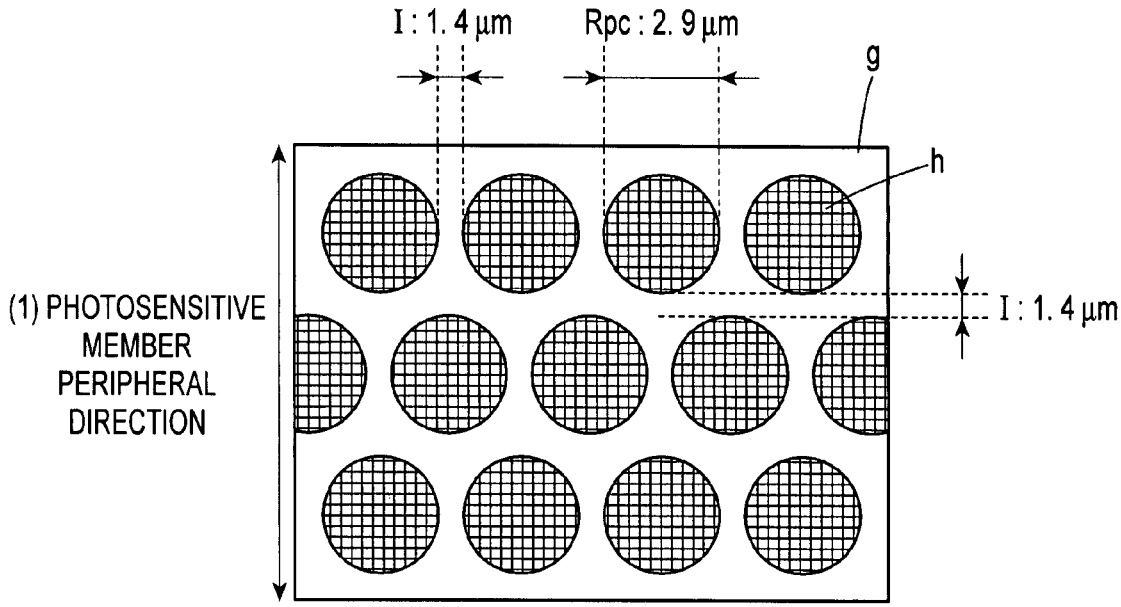
FIG. 21 is a view showing an arrangement pattern of depressed portions (partial enlarged view) of the photosensitive member outermost surface obtained according to Example 24.

The surface profile was measured in the same way as that in Example 1 to ascertain that depressed portions as shown in FIG. 21 stood formed. The results of measurement are shown in Table 2. The depressed portions were formed at intervals of 1.4 μm. Their opening area percentage was found to be 41%. Performance of the electrophotographic photosensitive member was also evaluated in the same way as that in Example 1. The results are shown in Table 2.

Example 25

An electrophotographic photosensitive member was produced in the same manner as that in Example 24, and a surface profile was formed in the same way as that in Example 24 except that the surface was irradiated with the laser light five times per irradiation portion of 2 mm square. The surface profile was measured in the same way as that in Example 1 to ascertain that depressed portions stood formed. The results of measurement are shown in Table 2. The depressed portions were formed at intervals of 1.4 μm. Their opening area percentage was found to be 41%. Performance of the electrophotographic photosensitive member was also evaluated in the same way as that in Example 1. The results are shown in Table 2.

Example 26

Figure 22:
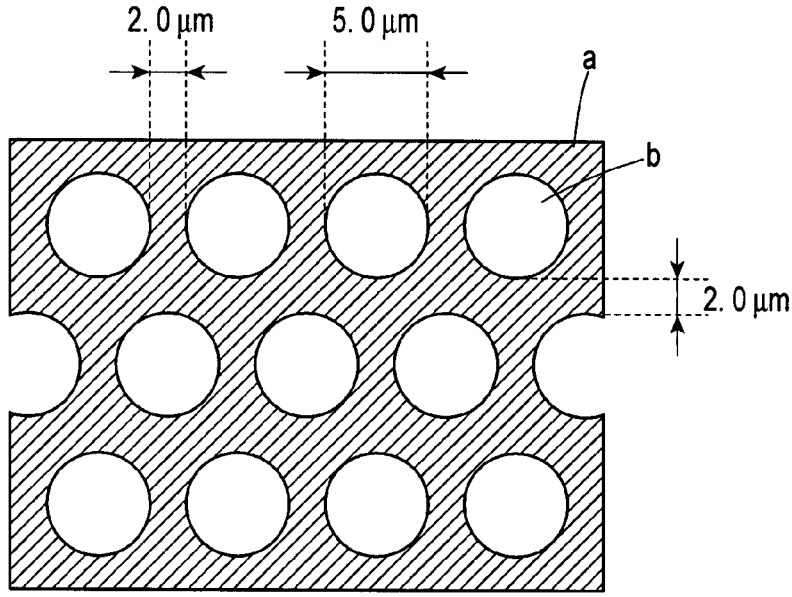
FIG. 22 is a view showing an arrangement pattern of a mask (partial enlarged view) used in Example 26.
Figure 23:
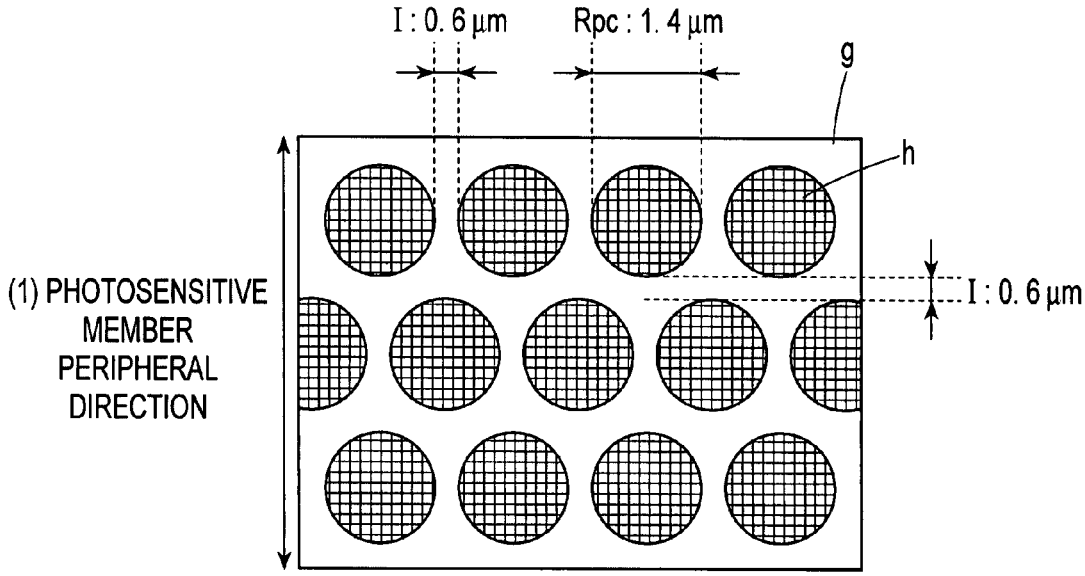
FIG. 23 is a view showing an arrangement pattern of depressed portions (partial enlarged view) of the photosensitive member outermost surface obtained according to Example 26.

An electrophotographic photosensitive member was produced in the same manner as that in Example 24, and a surface profile was formed in the same way as that in Example 24 except that a mask made of quartz glass was used which had a pattern in which circular laser light transmitting areas of 5.0 μm in diameter as shown in FIG. 22 are arranged at intervals of 2.0 μm as shown in the drawing. The surface profile was measured in the same way as that in Example 1 to ascertain that depressed portions as shown in FIG. 23 stood formed. The results of measurement are shown in Table 2. The depressed portions were formed at intervals I of 0.6 μm. Their opening area percentage was found to be 44%. Performance of the electrophotographic photosensitive member was also evaluated in the same way as that in Example 1. The results are shown in Table 2.

Example 27

The procedure of Example 1 was repeated to form on the support the conductive layer, the intermediate layer and the charge generation layer.

Next, 10 parts of the charge transporting material having the structure represented by the above formula (1) and 10 parts of polycarbonate resin (trade name: IUPILON Z400; available from Mitsubishi Engineering-Plastics Corporation) as a binder resin were dissolved in a mixed solvent of 65 parts of chlorobenzene and 35 parts of dimethoxymethane to prepare a surface layer coating solution containing the charge transporting material. The surface layer coating solution thus prepared was applied on the charge generation layer by dip coating to coat the base member with the surface layer coating solution. The step of coating with the surface layer coating solution was carried out under conditions of a relative humidity of 45% and an atmospheric temperature of 25° C. On lapse of 60 seconds after the coating step was completed, the base member coated with the surface layer coating solution was retained for 120 seconds in a condensation-step unit the interior of which was previously conditioned at a relative humidity of 70% and an atmospheric temperature of 60° C. On lapse of 60 seconds after the condensation step was completed, the base member was put into an air blow dryer the interior of which was previously heated to 120° C., to carry out drying for 60 minutes. Thus, an electrophotographic photosensitive member was produced the charge transport layer of which was a surface layer.

Figure 24:
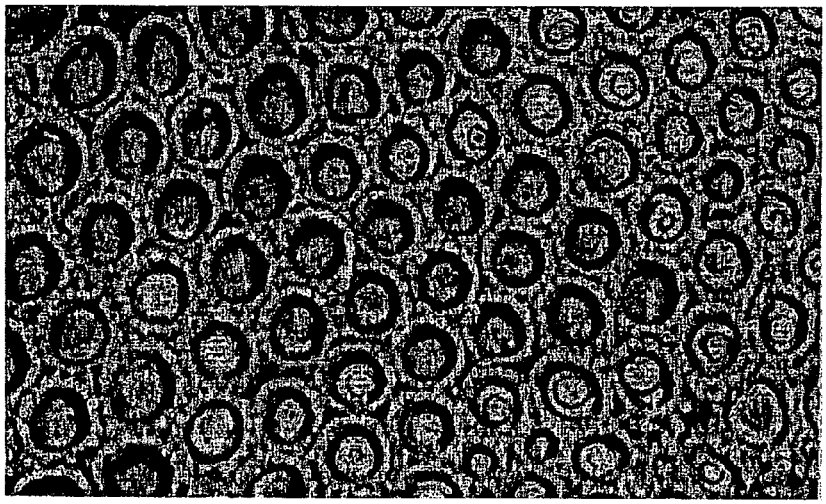
FIG. 24 shows an image of depressed portions observed on a laser electron microscope, on the surface of a photosensitive member produced in Example 27.

The surface profile was measured in the same way as that in Example 1 to ascertain that depressed portions stood formed. An image viewed on a laser microscope, of the surface of the electrophotographic photosensitive member produced in Example 27 is shown in FIG. 24. The results of measurement are shown in Table 2. The depressed portions were formed at intervals of 1.8 μm. Their opening area percentage was found to be 44%. Performance of the electrophotographic photosensitive member was also evaluated in the same way as that in Example 1. The results are shown in Table 2.

As an electrophotographic photosensitive member the surface of which was not processed for the depressed portions, used in evaluating the electrophotographic photosensitive member on its torque rate, a photosensitive member having no depressed portion on its surface was used, which was obtained by carrying out the drying for 60 minutes immediately after the base member was coated with the surface layer coating solution in the above photosensitive member production.

Example 28

The procedure of Example 27 was repeated to form on the support the conductive layer, the intermediate layer and the charge generation layer, and an electrophotographic photosensitive member was produced in the same manner as that in Example 27 except that in the condensation step the relative humidity was changed to 70% and the atmospheric temperature to 45° C. The surface profile was measured in the same way as that in Example 1 to ascertain that depressed portions stood formed. The results of measurement are shown in Table 2. The depressed portions were formed at intervals of 0.6 μm. Their opening area percentage was found to be 46%. Performance of the electrophotographic photosensitive member was also evaluated in the same way as that in Example 1. The results are shown in Table 2.

Example 29

The procedure of Example 1 was repeated to form on the support the conductive layer, the intermediate layer and the charge generation layer.

Next, 10 parts of the charge transporting material having the structure represented by the above formula (1) and 10 parts of the polyarylate resin represented by the above formula (5) were dissolved in a mixed solvent of 50 parts of chlorobenzene, 30 parts of oxolane and 20 parts of dimethoxymethane to prepare a surface layer coating solution containing the charge transporting material. The surface layer coating solution thus prepared was applied on the charge generation layer by dip coating to coat the base member with the surface layer coating solution. The step of coating with the surface layer coating solution was carried out under conditions of a relative humidity of 45% and an atmospheric temperature of 25° C. On lapse of 60 seconds after the coating step was completed, the base member coated with the surface layer coating solution was retained for 120 seconds in a condensation-step unit the interior of which was previously conditioned at a relative humidity of 70% and an atmospheric temperature of 60° C. On lapse of 60 seconds after the condensation step was completed, the base member was put into an air blow dryer the interior of which was previously heated to 120° C., to carry out drying for 60 minutes. Thus, an electrophotographic photosensitive member was produced the charge transport layer of which was a surface layer.

The surface profile was measured in the same way as that in Example 1 to ascertain that depressed portions stood formed. The results of measurement are shown in Table 2. The depressed portions were formed at intervals of 2.6 μm. Their opening area percentage was found to be 47%. Performance of the electrophotographic photosensitive member was also evaluated in the same way as that in Example 1. The results are shown in Table 2.

As an electrophotographic photosensitive member the surface of which was not processed for the depressed portions, used in evaluating the electrophotographic photosensitive member on its torque rate, a photosensitive member having no depressed portion on its surface was used, which was obtained by carrying out the drying for 60 minutes immediately after the base member was coated with the surface layer coating solution in the above photosensitive member production.

Example 30

The procedure of Example 1 was repeated to form on the support the conductive layer, the intermediate layer and the charge generation layer.

Next, 10 parts of the charge transporting material having the structure represented by the above formula (1) and as a binder resin 10 parts of polyarylate resin represented by the following formula (6):

(6)

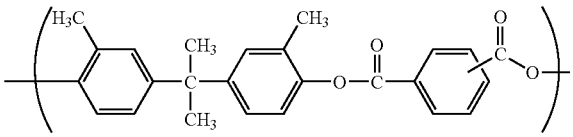

(in the above polyarylate resin, the molar ratio of terephthalic acid structure to isophthalic acid structure (terephthalic acid structure:isophthalic acid structure) is 50:50; the resin has a weight average molecular weight Mw of 130,000) were dissolved in a mixed solvent of 70 parts of chlorobenzene, 32 parts of dimethoxymethane and 3 parts of (methylsulfinyl) methane to prepare a surface layer coating solution containing the charge transporting material. The surface layer coating solution thus prepared was applied on the charge generation layer by dip coating to coat the base member with the surface layer coating solution. The step of coating with the surface layer coating solution was carried out under conditions of a relative humidity of 45% and an atmospheric temperature of 25° C. On lapse of 10 seconds after the coating step was completed, the base member coated with the surface layer coating solution was retained for 10 seconds in a condensation-step unit the interior of which was previously conditioned at a relative humidity of 50% and an atmospheric temperature of 30° C. On lapse of 240 seconds after the condensation step was completed, the base member was put into an air blow dryer the interior of which was previously heated to 120° C., to carry out drying for 60 minutes. Thus, an electrophotographic photosensitive member was produced the charge transport layer of which was a surface layer.

The surface profile was measured in the same way as that in Example 1 to ascertain that depressed portions stood formed. The results of measurement are shown in Table 2. The depressed portions were formed at intervals of 0.5 μm. Their opening area percentage was found to be 67%. Performance of the electrophotographic photosensitive member was also evaluated in the same way as that in Example 1. The results are shown in Table 2.

As an electrophotographic photosensitive member the surface of which was not processed for the depressed portions, used in evaluating the electrophotographic photosensitive member on its torque rate, a photosensitive member having no depressed portion on its surface was used, which was obtained by carrying out the drying for 60 minutes immediately after the base member was coated with the surface layer coating solution in the above photosensitive member production.

Example 31

The procedure of Example 1 was repeated to form on the support the conductive layer, the intermediate layer and the charge generation layer.

Next, 10 parts of the charge transporting material having the structure represented by the above formula (1) and as a binder resin 10 parts of polyarylate resin represented by the above formula (6) (in the above polyarylate resin, the molar ratio of terephthalic acid structure to isophthalic acid structure (terephthalic acid structure:isophthalic acid structure) is 50:50; the resin has a weight average molecular weight Mw of 130,000) were dissolved in a mixed solvent of 70 parts of chlorobenzene, 32 parts of dimethoxymethane and 3 parts of (methylsulfinyl)methane to prepare a surface layer coating solution containing the charge transporting material. The surface layer coating solution thus prepared was so cooled as to have a coating solution temperature of 15° C., and then applied on the charge generation layer by dip coating to coat the base member with the surface layer coating solution. The step of coating with the surface layer coating solution was carried out under conditions of a relative humidity of 45% and an atmospheric temperature of 25° C. On lapse of 10 seconds after the coating step was completed, the base member coated with the surface layer coating solution was retained for 60 seconds in a condensation-step unit the interior of which was previously conditioned at a relative humidity of 50% and an atmospheric temperature of 28° C. On lapse of 120 seconds after the condensation step was completed, the base member was put into an air blow dryer the interior of which was previously heated to 120° C., to carry out drying for 60 minutes. Thus, an electrophotographic photosensitive member was produced the charge transport layer of which was a surface layer.

The surface profile was measured in the same way as that in Example 1 to ascertain that depressed portions stood formed. The results of measurement are shown in Table 2. The depressed portions were formed at intervals of 0.3 μm. Their opening area percentage was found to be 72%. Performance of the electrophotographic photosensitive member was also evaluated in the same way as that in Example 1. The results are shown in Table 2.

As an electrophotographic photosensitive member the surface of which was not processed for the depressed portions, used in evaluating the electrophotographic photosensitive member on its torque rate, a photosensitive member having no depressed portion on its surface was used, which was obtained by carrying out the drying for 60 minutes immediately after the base member was coated with the surface layer coating solution in the above photosensitive member production.

Example 32

The procedure of Example 1 was repeated to form on the support the conductive layer, the intermediate layer and the charge generation layer.

Next, 5 parts of the charge transporting material having the structure represented by the above formula (1), 4 parts of a charge transporting material having a structure represented by the following formula (7):

(7)

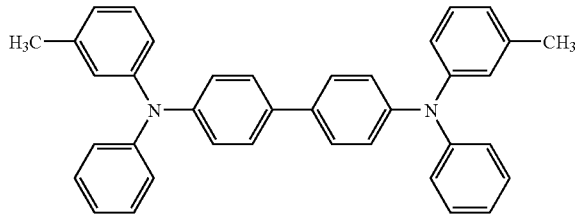

10 parts of the polyarylate resin represented by the above formula (4) (in the above, m and n each represent a ratio (copolymerization ratio) of repeating units in this resin. In this resin, m:n is 7:3, and the molar ratio of terephthalic acid structure to isophthalic acid structure (terephthalic acid structure:isophthalic acid structure) is 50:50; the resin has a weight average molecular weight Mw of 130,000) and 1 part of IRGANOX 1330 (available from Ciba Specialty Chemicals Inc.) as an antioxidant were dissolved in a mixed solvent of 70 parts of chlorobenzene and 35 parts of dimethoxymethane to prepare a surface layer coating solution containing the charge transporting material.

This coating solution was applied on the charge generation layer by dip coating, followed by heat drying for 30 minutes in an oven heated to 110° C., to form a charge transport layer as a surface layer, with an average layer thickness of 15 μm at the position of 170 mm from the support upper end.

The electrophotographic photosensitive member produced in the manner described above was subjected to surface processing in the same way as that in Example 1, but using the mold used in Example 18.

The surface profile was measured in the same way as that in Example 1 to ascertain that depressed portions stood formed. The results of measurement are shown in Table 2. The depressed portions were formed at intervals of 1.0 μm. Their opening area percentage was found to be 46%. Performance of the electrophotographic photosensitive member was also evaluated in the same way as that in Example 1. The results are shown in Table 2.

Example 33

An electrophotographic photosensitive member was produced in the same manner as that in Example 32 except that TINUVIN 622 LD (available from Ciba Specialty Chemicals Inc.) was used in place of the antioxidant used in Example 32. Its surface was processed in the same way as that in Example 32.

The surface profile was measured in the same way as that in Example 1 to ascertain that depressed portions stood formed. The results of measurement are shown in Table 2. The depressed portions were formed at intervals of 1.0 μm. Their opening area percentage was found to be 46%. Performance of the electrophotographic photosensitive member was also evaluated in the same way as that in Example 1. The results are shown in Table 2.

Example 34

The procedure of Example 1 was repeated to form on the support the conductive layer, the intermediate layer and the charge generation layer.

Next, a fluid prepared by adding 10 parts of tetrafluoroethylene resin powder (trade name: LUBRON L-2, available from Daikin Industries, Ltd.) to 90 parts of chlorobenzene was treated three times under a pressure of 600 kgf/cm$^2$ by means of a high-pressure dispersion machine (trade name: MICROFLUIDIZER M-110EH, manufactured by Microfluidics Inc., USA). Further, the fluid having been subjected to the above dispersion treatment was filtered with Polyfron filter (trade name: PF-040, available from Advantec Toyo Kaisha, Ltd.) to prepare a dispersion.

Next, 4 parts of the charge transporting material having the structure represented by the above formula (1), 4 parts of the charge transporting material having the structure represented by the above formula (7), 10 parts of the polyarylate resin represented by the above formula (4) (in the above, m and n each represent a ratio (copolymerization ratio) of repeating units in this resin. In this resin, m:n is 7:3, and the molar ratio of terephthalic acid structure to isophthalic acid structure (terephthalic acid structure:isophthalic acid structure) is 50:50; the resin has a weight average molecular weight Mw of 130,000) and 20 parts of the above dispersion were added to a mixed solvent of 58 parts of chlorobenzene and 35 parts of dimethoxymethane to prepare a surface layer coating solution containing the charge transporting material.

This coating solution was applied on the charge generation layer by dip coating, followed by heat drying for 30 minutes in an oven heated to 110° C., to form a charge transport layer as a surface layer, with an average layer thickness of 15 μm at the position of 170 mm from the support upper end.

The electrophotographic photosensitive member produced in the manner described above was subjected to surface processing in the same way as that in Example 1, using the mold used in Example 18.

The surface profile was measured in the same way as that in Example 1 to ascertain that depressed portions stood formed. The results of measurement are shown in Table 2. The depressed portions were formed at intervals of 1.0 μm. Their opening area percentage was found to be 46%. Performance of the electrophotographic photosensitive member was also evaluated in the same way as that in Example 1. The results are shown in Table 2.

Example 35

An electrophotographic photosensitive member was produced in the same manner as that in Example 34 except that surface-treated fine silica particles (average particle diameter: 0.1 μm; trade name: KMBX-100, available from Shin-Etsu Chemical Co., Ltd.) were used in place of the tetrafluoroethylene resin powder used in Example 34. Its surface was processed in the same way.

The surface profile was measured in the same way as that in Example 1 to ascertain that depressed portions stood formed. The results of measurement are shown in Table 2. The depressed portions were formed at intervals of 1.0 μm. Their opening area percentage was found to be 46%. Performance of the electrophotographic photosensitive member was also evaluated in the same way as that in Example 1. The results are shown in Table 2.

Example 36

An electrophotographic photosensitive member was produced in the same manner as that in Example 34 except that fine alumina particles (average particle diameter: 0.1 μm; trade name: LS-231, available from Nippon Light Metal Co., Ltd.) were used in place of the tetrafluoroethylene resin powder used in Example 34. Its surface was processed in the same way.

The surface profile was measured in the same way as that in Example 1 to ascertain that depressed portions stood formed. The results of measurement are shown in Table 2. The depressed portions were formed at intervals of 1.0 μm. Their opening area percentage was found to be 46%. Performance of the electrophotographic photosensitive member was also evaluated in the same way as that in Example 1. The results are shown in Table 2.

Example 37

The procedure of Example 1 was repeated to form on the support the conductive layer, the intermediate layer and the charge generation layer.

Next, a surface layer coating solution containing the same charge transporting material as that in Example 32 was prepared. The surface layer coating solution thus prepared was applied on the charge generation layer by dip coating to coat the base member with the surface layer coating solution. The step of coating with the surface layer coating solution was carried out under conditions of a relative humidity of 45% and an atmospheric temperature of 25° C. On lapse of 10 seconds after the coating step was completed, the base member coated with the surface layer coating solution was retained for 120 seconds in a condensation-step unit the interior of which was previously conditioned at a relative humidity of 70% and an atmospheric temperature of 35° C. On lapse of 240 seconds after the condensation step was completed, the base member was put into an air blow dryer the interior of which was previously heated to 120° C., to carry out drying for 60 minutes. Thus, an electrophotographic photosensitive member was produced the charge transport layer of which was a surface layer.

On the electrophotographic photosensitive member produced in the manner described above, the surface profile was measured in the same way as that in Example 1 to ascertain that depressed portions stood formed. The results of measurement are shown in Table 2. The depressed portions were formed at intervals of 1.8 μm. Their opening area percentage was found to be 44%. Performance of the electrophotographic photosensitive member was also evaluated in the same way as that in Example 1. The results are shown in Table 2.

As an electrophotographic photosensitive member the surface of which was not processed for the depressed portions, used in evaluating the electrophotographic photosensitive member on its torque rate, a photosensitive member having no depressed portion on its surface was used, which was obtained by carrying out the drying for 60 minutes immediately after the base member was coated with the surface layer coating solution in the above photosensitive member production.

Example 38

An electrophotographic photosensitive member was produced in the same manner as that in Example 37 except that TINUVIN 622 LD (available from Ciba Specialty Chemicals Inc.) was used in place of the antioxidant used in Example 37.

The surface profile was measured in the same way as that in Example 1 to ascertain that depressed portions stood formed. The results of measurement are shown in Table 2. The depressed portions were formed at intervals of 1.8 μm. Their opening area percentage was found to be 44%. Performance of the electrophotographic photosensitive member was also evaluated in the same way as that in Example 1. The results are shown in Table 2.

As an electrophotographic photosensitive member the surface of which was not processed for the depressed portions, used in evaluating the electrophotographic photosensitive member on its torque rate, a photosensitive member having no depressed portion on its surface was used, which was obtained by carrying out the drying for 60 minutes immediately after the base member was coated with the surface layer coating solution in the above photosensitive member production.

Example 39

The procedure of Example 1 was repeated to form on the support the conductive layer, the intermediate layer and the charge generation layer.

Next, a surface layer coating solution containing the same charge transporting material as that in Example 34 was prepared. The surface layer coating solution thus prepared was applied on the charge generation layer by dip coating to coat the base member with the surface layer coating solution. The step of coating with the surface layer coating solution was carried out under conditions of a relative humidity of 45% and an atmospheric temperature of 25° C. On lapse of 10 seconds after the coating step was completed, the base member coated with the surface layer coating solution was retained for 120 seconds in a condensation-step unit the interior of which was previously conditioned at a relative humidity of 70% and an atmospheric temperature of 35° C. On lapse of 240 seconds after the condensation step was completed, the base member was put into an air blow dryer the interior of which was previously heated to 120° C., to carry out drying for 60 minutes. Thus, an electrophotographic photosensitive member was produced the charge transport layer of which was a surface layer.

On the electrophotographic photosensitive member produced in the manner described above, the surface profile was measured in the same way as that in Example 1 to ascertain that depressed portions stood formed. The results of measurement are shown in Table 2. The depressed portions were formed at intervals of 1.8 μm. Their opening area percentage was found to be 44%. Performance of the electrophotographic photosensitive member was also evaluated in the same way as that in Example 1. The results are shown in Table 2.

As an electrophotographic photosensitive member the surface of which was not processed for the depressed portions, used in evaluating the electrophotographic photosensitive member on its torque rate, a photosensitive member having no depressed portion on its surface was used, which was obtained by carrying out the drying for 60 minutes immediately after the base member was coated with the surface layer coating solution in the above photosensitive member production.

Example 40

An electrophotographic photosensitive member was produced in the same manner as that in Example 39 except that surface-treated fine silica particles (average particle diameter: 0.1 μm; trade name: LS-231, available from Nippon Light Metal Co., Ltd.) were used in place of the tetrafluoroethylene resin powder used in Example 39. Its surface was processed in the same way.

The surface profile was measured in the same way as that in Example 1 to ascertain that depressed portions stood formed. The results of measurement are shown in Table 2. The depressed portions were formed at intervals of 1.8 μm. Their opening area percentage was found to be 44%. Performance of the electrophotographic photosensitive member was also evaluated in the same way as that in Example 1. The results are shown in Table 2.

Example 41

An electrophotographic photosensitive member was produced in the same manner as that in Example 39 except that fine alumina particles (average particle diameter: 0.1 μm; trade name: LS-231, available from Nippon Light Metal Co., Ltd.) were used in place of the tetrafluoroethylene resin powder used in Example 39. Its surface was processed in the same way.

The surface profile was measured in the same way as that in Example 1 to ascertain that depressed portions stood formed. The results of measurement are shown in Table 2. The depressed portions were formed at intervals of 1.8 μm. Their opening area percentage was found to be 44%. Performance of the electrophotographic photosensitive member was also evaluated in the same way as that in Example 1. The results are shown in Table 2.

TABLE 2

| Example: | Number (depressed portions) | Rpc-A (μm) | Rdv-A (μm) | Rdv-A/Rpc-A | Torque rate | Blade chattering in 50,000-sheet running |
|---|---|---|---|---|---|---|
| 21 | 1,280 | 2.0 | 3.0 | 1.5 | 0.38 | Good. |
| 22 | 2,200 | 1.5 | 3.5 | 2.3 | 0.3 | Good. |
| 23 | 320 | 4.0 | 4.5 | 1.1 | 0.30 | Good. |
| 24 | 625 | 2.9 | 3.2 | 1.1 | 0.35 | Good. |
| 25 | 625 | 2.9 | 5.3 | 1.8 | 0.33 | Good. |
| 26 | 2,890 | 1.4 | 3.5 | 2.5 | 0.3 | Good. |
| 27 | 320 | 4.2 | 6.0 | 1.4 | 0.33 | Good. |
| 28 | 2,600 | 1.5 | 2.0 | 1.3 | 0.40 | Good. |
| 29 | 120 | 6.8 | 7.2 | 1.1 | 0.35 | Good. |
| 30 | 940 | 3.0 | 3.5 | 1.2 | 0.33 | Good. |
| 31 | 1,475 | 2.5 | 2.7 | 1.1 | 0.33 | Good. |
| 32 | 400 | 3.0 | 3.5 | 1.2 | 0.43 | Good. |
| 33 | 400 | 3.0 | 3.5 | 1.2 | 0.43 | Good. |
| 34 | 400 | 3.0 | 3.5 | 1.2 | 0.50 | Good. |
| 35 | 400 | 3.0 | 3.5 | 1.2 | 0.40 | Good. |
| 36 | 400 | 3.0 | 3.5 | 1.2 | 0.40 | Good. |
| 37 | 320 | 4.2 | 6.0 | 1.4 | 0.33 | Good. |
| 38 | 320 | 4.0 | 6.0 | 1.5 | 0.33 | Good. |
| 39 | 320 | 4.0 | 5.5 | 1.4 | 0.45 | Good. |
| 40 | 320 | 4.5 | 6.0 | 1.3 | 0.30 | Good. |
| 41 | 320 | 4.2 | 6.0 | 1.4 | 0.33 | Good. |

The results of Examples 21 to 41 demonstrate that, the electrophotographic photosensitive member having on its surface the depressed portions each having the ratio of depth to major-axis diameter, Rdv/Rpc, of from more than 1.0 to 7.0 or less enables much better prevention of the blade chattering at the time of repeated service.

The present invention is not limited to the above embodiments and various changes and modifications can be made within the spirit and scope of the present invention. Therefore to apprise the public of the scope of the present invention, the following claims are made.

This application claims priorities from Japanese Patent Application No. 2006-022896 filed on Jan. 31, 2006, Japanese Patent Application No. 2006-022898 filed on Jan. 31, 2006, Japanese Patent Application No. 2006-022899 filed on Jan. 31, 2006, Japanese Patent Application No. 2006-022900 filed on Jan. 31, 2006 and Japanese Patent Application No. 2007-016216 filed on Jan. 26, 2007, the contents of which are incorporated hereinto by reference.

What is claimed is:

1. An electrophotographic photosensitive member which comprises a support and provided thereon a photosensitive layer, wherein the electrophotographic photosensitive member has a surface having a plurality of depressed portions which are independent from one another, and, where the major-axis diameter of each depressed portion is represented by Rpc and the depth that shows the distance between the deepest part of each depressed portion and the opening thereof is represented by Rdv, the depressed portions each have a ratio of depth to major-axis diameter, Rdv/Rpc, of from more than 1.0 to 7.0 or less.

2. The electrophotographic photosensitive member according to claim 1, which has the depressed portions in a number of from 50 or more to 70,000 or less in 100 μm square of the surface of the electrophotographic photosensitive member surface.

3. The electrophotographic photosensitive member according to claim 1, wherein, in the electrophotographic photosensitive member having on its surface the depressed portions specified in claim 1, the average depth (Rdv-A) of the depressed portions is from more than 3.0 μm to 10.0 μm or less.

4. The electrophotographic photosensitive member according to claim 1, wherein, in the electrophotographic photosensitive member having on its surface the depressed portions specified in claim 1, the ratio of average depth (Rdv-A) to average major-axis diameter (Rpc-A), Rdv-A/Rpc-A, of the depressed portions of the electrophotographic photosensitive member surface is from more than 1.0 to 7.0 or less.

5. The electrophotographic photosensitive member according to claim 4, wherein the ratio of average depth (Rdv-A) to average major-axis diameter (Rpc-A), Rdv-A/Rpc-A, of the depressed portions is from more than 1.3 or more to 5.0 or less.

6. A process cartridge which comprises the electrophotographic photosensitive member according to claim 1, and at least one device selected from the group consisting of a charging device, a developing device and a cleaning device; the process cartridge being detachably mountable to the main body of an electrophotographic apparatus.

7. An electrophotographic apparatus which comprises the electrophotographic photosensitive member according to claim 1, a charging device, an exposure device, a developing device and a transfer device.

* * * * *